US012345259B2

(12) United States Patent
Jo et al.

(10) Patent No.: US 12,345,259 B2
(45) Date of Patent: Jul. 1, 2025

(54) SCROLL COMPRESSOR

(71) Applicant: LG ELECTRONICS INC., Seoul (KR)

(72) Inventors: Changeol Jo, Seoul (KR); Jeonghun Kim, Seoul (KR); Nara Han, Seoul (KR); Juhwan Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/836,795

(22) PCT Filed: Nov. 17, 2022

(86) PCT No.: PCT/KR2022/018240
§ 371 (c)(1),
(2) Date: Aug. 8, 2024

(87) PCT Pub. No.: WO2024/034741
PCT Pub. Date: Feb. 15, 2024

(65) Prior Publication Data

US 2025/0146488 A1 May 8, 2025

(30) Foreign Application Priority Data

Aug. 9, 2022 (KR) ..... 10-2022-0099477

(51) Int. Cl.
*F04C 18/02* (2006.01)
*F04C 28/24* (2006.01)

(52) U.S. Cl.
CPC ..... *F04C 18/023* (2013.01); *F04C 28/24* (2013.01)

(58) Field of Classification Search
CPC ..... F04C 18/023; F04C 18/0215; F04C 18/0261; F04C 18/0269; F04C 18/0253; F04C 18/0246; F04C 28/24; F04C 28/10; F04C 28/12; F04C 28/16; F04C 29/12; F04C 29/00; F04C 29/0021; F04C 2270/18; F04C 2270/185
See application file for complete search history.

(56) References Cited

U.S. PATENT DOCUMENTS 10,316,843 B2 * 6/2019 Jin ..... F04C 28/26
10,428,819 B2 * 10/2019 Jin ..... F04C 18/0261
2015/0176585 A1 6/2015 Sun
(Continued)

FOREIGN PATENT DOCUMENTS

JP 2010163976 A * 7/2010

OTHER PUBLICATIONS

Machine Translation JP 2010-163976 (Year: 2025).*

*Primary Examiner* — Dapinder Singh
(74) *Attorney, Agent, or Firm* — KED & ASSOCIATES

(57) ABSTRACT

A scroll compressor is disclosed. The scroll compressor has back pressure holes which are formed in a non-orbiting scroll and a back pressure chamber assembly, and provide communication between a compression chamber and a back pressure chamber. In addition, a back pressure valve is provided inside of the back pressure hole to change a passage area of the back pressure hole by moving along a longitudinal direction of the back pressure hole due to a pressure difference between the compression chamber and the back pressure chamber. Due to the back pressure valve, pressure pulsation in the back pressure chamber may be improved.

16 Claims, 12 Drawing Sheets

(56) References Cited

U.S. PATENT DOCUMENTS

| | | | | |
|---|---|---|---|---|
| 2015/0345493 | A1 | 12/2015 | Lochner et al. | |
| 2019/0249667 | A1* | 8/2019 | Jin | F04C 18/0215 |
| 2019/0360489 | A1* | 11/2019 | Jin | F04C 29/0085 |
| 2020/0088197 | A1* | 3/2020 | Kim | F04C 18/0215 |
| 2021/0396228 | A1* | 12/2021 | Jo | F04C 23/008 |
| 2022/0316476 | A1* | 10/2022 | Teshima | F04C 18/0261 |

* cited by examiner

SCROLL COMPRESSOR

CROSS-REFERENCE TO RELATED PATENT APPLICATIONS

This application is a U.S. National Stage Application under 35 U.S.C. § 371 of PCT Application No. PCT/KR2022/018240, filed Nov. 17, 2022, which claims priority to Korean Patent Application No. 10-2022-0099477, filed Aug. 9, 2022, whose entire disclosures are hereby incorporated by reference.

TECHNICAL FIELD

The present disclosure relates to a scroll compressor.

BACKGROUND ART

Scroll compressors have advantages of obtaining a relatively high compression ratio, as compared with other types of compressors, because refrigerant is continuously compressed by a shape of scrolls engaged with each other, and of obtaining stable torques by smooth connection of suction, compression, and discharge strokes. By virtue of those advantages, the scroll compressors are widely used for compressing refrigerant in air conditioners and the like.

Scroll compressors may be classified into a top-compression type or a bottom-compression type depending on positions of a drive motor constituting a drive unit or a motor unit and a compression unit. The top-compression type is configured such that the compression unit is located above the drive motor, whereas the bottom-compression type is configured such that the compression unit is located below the drive motor. This classification is made based on an example in which a casing is vertically installed. When the casing is horizontally installed, a left side may be defined as a top (or upper side) and a right side as a bottom (or lower side).

Also, scroll compressors may be classified into a high-pressure type and a low-pressure type according to how refrigerant is suctioned. The high-pressure type is configured such that a refrigerant suction pipe directly communicates with a suction chamber to suction refrigerant into a compression chamber (the suction chamber) without passing through an inner space of a casing, whereas the low-pressure type is configured such that the refrigerant suction pipe communicates with the inner space of the casing to suction the refrigerant into the compression chamber (the suction chamber) after passing through the inner space of the casing.

Patent Document 1 (US Patent Publication No. US 2015/0345493 A1) shows a scroll compressor that is a top compression and low pressure type.

In addition, in the related art scroll compressor such as Patent Document 1, a non-orbiting scroll may maintain a sealing state with an orbiting scroll while moving along an axial direction of a rotational shaft according to pressure of a compression chamber. This may be classified as a non-orbiting back pressure type scroll compressor.

In the related art non-orbiting back pressure type scroll compressor as described above, there is no component that can adjust back pressure in a refrigerant passage, through which a compression chamber and a back pressure chamber communicate with each other, during a repeated compression process, so pulsations in the back pressure chamber continuously occur. This acts as a dead volume of the compression chamber and causes an increase in compression loss.

Patent Document 2 (US Patent Publication No. US 2015/0176585 A1) is implemented to improve intermediate-pressure pulsation by installing a valve in a refrigerant passage, through which the compression chamber and the back pressure chamber communicate with each other, but the valve has a complex structure and a large number of parts, which causes an increase in manufacturing time and manufacturing cost of the compressor.

DISCLOSURE OF INVENTION

Technical Problem

An aspect of the present disclosure is to provide a scroll compressor that is capable of improving pressure pulsation in a back pressure chamber by disposing a back pressure valve in a refrigerant passage, through which a compression chamber and a back pressure chamber communicate with each other, in a non-orbiting back pressure type scroll compressor.

Solution to Problem

The aspect of the present disclosure will be achieved by the following.

A scroll compressor according to the present disclosure may include a casing, a high/low pressure separation plate, a main frame, an orbiting scroll, a non-orbiting scroll, a back pressure chamber assembly, and a back pressure hole. The high/low pressure separation plate is fixed inside the casing and divides the inside of the casing into a low-pressure part forming a suction space and a high-pressure part forming a discharge space. The main frame is fixed inside the casing and disposed in the low-pressure part. The orbiting scroll is supported on the main frame in an axial direction to perform an orbital motion. The non-orbiting scroll is movable in the axial direction with respect to one side surface of the main frame with the orbiting scroll disposed therebetween, and forms a compression chamber together with the orbiting scroll. The back pressure chamber assembly is disposed between the high/low pressure separation plate and the non-orbiting scroll and includes a back pressure chamber formed in an annular shape. The back pressure hole is disposed in the non-orbiting scroll and the back pressure chamber assembly, such that the compression chamber and the back pressure chamber communicate with each other. A back pressure valve is disposed inside the back pressure hole, and moves along a longitudinal direction of the back pressure hole due a pressure difference between the compression chamber and the back pressure chamber to vary a passage area of the back pressure hole. Through this, pressure pulsations in the back pressure chamber can be suppressed.

In one exemplary embodiment of the present disclosure, the back pressure valve includes a valve body that forms a first refrigerant passage together with an inner circumferential surface of the back pressure hole, and a plurality of refrigerant movement holes that are formed through an inside of the valve body to form a second refrigerant passage. This can result in varying a passage area of the back pressure hole along which refrigerant moves.

Specifically, the valve body is formed in a spherical shape, and the plurality of refrigerant movement holes are formed to intersect one another. By virtue of the spherical valve body, the movement of refrigerant is not interfered and manufacturing of the valve is facilitated. Additionally, the refrigerant can move through any one of the refrigerant movement holes that intersect one another.

Specifically, the plurality of refrigerant movement holes are formed along three axial directions that are orthogonal to one another. Accordingly, at least one of the plurality of refrigerant movement holes communicates with the back pressure hole.

In the one exemplary embodiment, the first refrigerant passage and the second refrigerant passage are open when the pressure of the compression chamber is higher than the pressure of the back pressure chamber. Accordingly, the back pressure valve does not interfere with an increase in pressure in the back pressure chamber. And, the first refrigerant passage is closed and the second refrigerant passage is open when the pressure of the compression chamber is lower than the pressure of the back pressure chamber. This can reduce an amount of refrigerant moving to the compression chamber, and thus slowly lower the pressure of the back pressure chamber, thereby suppressing pressure pulsation in the back pressure chamber.

Specifically, the back pressure hole includes a scroll-side back pressure hole and a plate-side back pressure hole. The scroll-side back pressure hole is formed in the non-orbiting scroll and communicates with the compression chamber. The plate-side back pressure hole is formed in the back pressure chamber assembly and communicates with the scroll-side back pressure hole and the back pressure chamber. Additionally, the scroll-side back pressure hole and the plate-side back pressure hole are formed eccentrically from each other, and the back pressure valve is disposed inside the scroll-side back pressure hole. This can limit the back pressure valve not to move out of the scroll-side back pressure hole toward the plate-side back pressure hole.

Specifically, the scroll-side back pressure hole includes a first scroll-side back pressure hole and a second scroll-side back pressure hole. The first scroll-side back pressure hole communicates with the plate-side back pressure hole, and one end portion of the second scroll-side back pressure hole communicates with the first scroll-side back pressure hole and another end portion communicates with the compression chamber. Additionally, an inner diameter of the first scroll-side back pressure hole is formed to be larger than an inner diameter of the second scroll-side back pressure hole, and the back pressure valve is inserted into the first scroll-side back pressure hole. Accordingly, the back pressure valve is limited not to move from the first scroll-side back pressure hole to the second scroll-side back pressure hole.

Specifically, a step portion is formed between the first scroll-side back pressure hole and the second scroll-side back pressure hole to limit movement of the back pressure valve. The step portion is formed to be tilted in a direction toward the second scroll-side back pressure hole. Accordingly, since the back pressure valve is seated on the step portion, the movement of the back pressure valve toward the second scroll-side back pressure hole is limited.

Specifically, a shortest length of a circumference connecting two adjacent refrigerant movement holes among the plurality of refrigerant movement holes formed in the valve body is smaller than an inner diameter of the second scroll-side back pressure hole. Accordingly, at least one refrigerant movement hole among the plurality of refrigerant movement holes communicates with the second scroll-side back pressure hole.

In another exemplary embodiment, the back pressure valve further includes expansion grooves formed in respective end portions of the plurality of refrigerant movement holes. Accordingly, the refrigerant that has passed through the refrigerant movement hole can more easily move to the outside of the back pressure valve through the expansion groove.

Specifically, a shortest length of a circumference connecting two adjacent expansion grooves among the expansion grooves is smaller than the inner diameter of the second scroll-side back pressure hole. Accordingly, at least one expansion groove among the expansion grooves communicates with the second scroll-side back pressure hole.

In the one exemplary embodiment, the back pressure chamber assembly includes a connection back pressure groove through which the plate-side back pressure hole and the scroll-side back pressure hole communicate with each other, and an inner diameter of the connection back pressure groove is formed to be larger than an inner diameter of the scroll-side back pressure hole. This can expand a space in which the refrigerant can move, thereby enabling a smooth movement of the refrigerant.

Specifically, the connection back pressure groove is formed on a same axis with respect to the scroll-side back pressure hole and is formed eccentrically from the plate-side back pressure hole. Accordingly, the connection back pressure groove can play a role of a refrigerant passage for moving refrigerant and a role of limiting movement of the back pressure valve.

In another exemplary embodiment, a valve limiting portion is formed on the connection back pressure groove to extend axially toward the non-orbiting scroll and limits movement of the back pressure valve. Accordingly, the back pressure valve can move inside the scroll-side back pressure hole, but cannot move to the plate-side back pressure hole due to the valve limiting portion.

Specifically, a height of the valve limiting portion is less than or equal to a depth of the connection back pressure groove. Accordingly, a space in which the refrigerant can move can be expanded so that the refrigerant can move smoothly, or a movable distance of the back pressure valve can be reduced, which can minimize wear on an inner circumferential surface of the scroll-side back pressure hole and the back pressure chamber assembly.

In another exemplary embodiment, a portion of the scroll-side back pressure hole is covered with one surface of the back pressure chamber assembly, and the back pressure valve axially overlaps one surface of the back pressure chamber assembly that covers the scroll-side back pressure hole. This can limit the back pressure valve not to move out of the scroll-side back pressure hole toward the plate-side back pressure hole.

In still another exemplary embodiment, the back pressure hole includes a scroll-side back pressure hole and a plate-side back pressure hole. The scroll-side back pressure hole is formed in the non-orbiting scroll and communicates with the compression chamber. The plate-side back pressure hole is formed in the back pressure chamber assembly, and allows the scroll-side back pressure hole and the back pressure chamber to communicate with each other. The scroll-side back pressure hole and the plate-side back pressure hole are formed eccentrically from each other, and the back pressure valve is disposed inside the plate-side back pressure hole. This can limit the back pressure valve not to move out of the plate-side back pressure hole toward the scroll-side back pressure hole.

Specifically, a plate-side valve limiting portion is formed to protrude from an inner circumferential surface in one end portion, opposite to the scroll-side back pressure hole, of both end portions of the plate-side back pressure hole, so as to limit movement of the back pressure valve. An inner diameter of the plate-side valve limiting portion is formed to be smaller than an outer diameter of the back pressure valve. Therefore, the back pressure valve cannot move out of the plate-side back pressure hole toward the back pressure chamber.

Advantageous Effects of Invention

In a scroll compressor according to the present disclosure, a back pressure valve may be disposed in a back pressure hole as a refrigerant passage, through which a compression chamber and a back pressure chamber communicate with each other, to vary a passage area of the back pressure hole during movement, thereby achieving an effect of improving pressure pulsation in the back pressure chamber.

In addition, in the scroll compressor according to the present disclosure, the back pressure valve has a simple structure and a light weight and is configured as an integral body, which can provide an effect of improving convenience of assembly and structural reliability.

MODE FOR THE INVENTION

Figure 1:
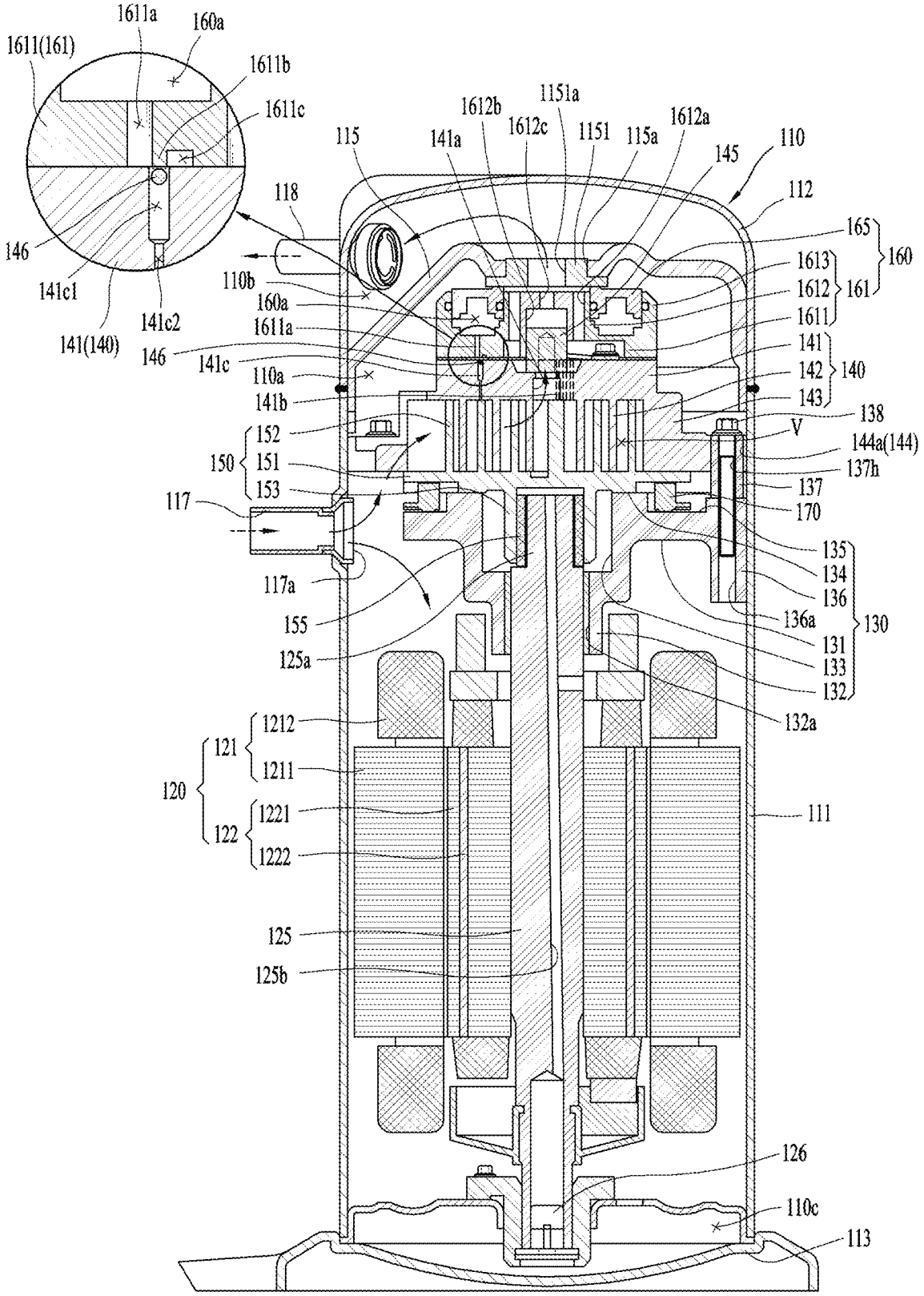
FIG. 1 is a longitudinal sectional view illustrating an inner structure of a scroll compressor according to an embodiment of the present disclosure.

Hereinafter, a scroll compressor according to the present disclosure will be described in detail according to an exemplary embodiment illustrated in the accompanying drawings.

As aforementioned, scroll compressors may be classified into a high-pressure scroll compressor and a low-pressure scroll compressor according to a path along which refrigerant is suctioned. Hereinafter, a description will be given of a low-pressure type scroll compressor, as an example, in which an inner space of a casing is partitioned (divided) into a low-pressure part and a high-pressure part by a high/low pressure separation plate, and a refrigerant suction pipe communicates with the low-pressure part.

In addition, scroll compressors may be classified into two types according to a back pressure type (a method of applying back pressure), namely, a non-orbiting back pressure type in which a non-orbiting scroll is pressed toward an orbiting scroll and an orbiting back pressure type in which the orbiting scroll is pressed toward the non-orbiting scroll. Hereinafter, a scroll compressor according to a non-orbiting back pressure type will be mainly described. However, it should be noted that the present disclosure can be equally applied to the orbiting back pressure type.

In addition, scroll compressors may be classified into two types, namely, a vertical scroll compressor in which a rotational shaft is disposed perpendicular to the ground and a horizontal scroll compressor in which the rotational shaft is disposed parallel to the ground. For example, in the vertical scroll compressor, an upper side (or top) may be defined as an opposite side to the ground and a lower side (or bottom) may be defined as a side facing the ground. Hereinafter, the vertical scroll compressor will be described as an example. However, it should be noted that the present disclosure can be equally applied to the horizontal scroll compressor.

In addition, scroll compressors may be divided into two types, namely, a top compression type and a bottom compression type, depending on a relative position of a compression unit with respect to a motor unit. Hereinafter, a top-compression type scroll compressor that is installed vertically and has a compression unit located above a motor unit will be mainly described.

Scroll compressors may also be divided into two types, namely, a fixed radius type and a variable radius type, depending on a way of orbiting an orbiting scroll. Hereinafter, a variable radius type scroll compressor will be mainly described.

Meanwhile, in the related art scroll compressor, pulsations continuously occur in a back pressure chamber, which communicates with a compression chamber, during repeated compression in the compression chamber. This acts as a dead volume of the compression chamber, causing compression loss.

Therefore, a description will be given of a new type of scroll compressor in which pressure pulsation in a back pressure chamber can be suppressed by placing a movable back pressure valve inside a back pressure hole, through which a compression chamber and the back pressure chamber communicate with each other.

As illustrated in FIG. 1, in a scroll compressor according to an exemplary embodiment of the present disclosure, a drive motor 120 forming a motor unit is disposed in a lower half portion of the casing 110, and a main frame 130, a non-orbiting scroll 140, an orbiting scroll 150, and a back pressure chamber assembly 160 forming a compression unit are disposed above the drive motor 120. The motor unit is coupled to one end of a rotational shaft 125, and the compression unit is coupled to another end of the rotational shaft 125. Accordingly, the compression unit is connected to the motor unit by the rotational shaft 125 to be operated by rotational force of the motor unit.

The casing 110 includes a cylindrical shell 111, an upper cap 112, and a lower cap 113.

The cylindrical shell 111 may have a cylindrical shape with upper and lower ends open, and the drive motor 120 and the main frame 130 may be fitted on an inner circumferential surface of the cylindrical shell 111 in an inserting manner. A terminal bracket (not illustrated) is coupled to an upper half portion of the cylindrical shell 111. A terminal (not illustrated) for transmitting external power to the drive motor 120 is coupled through the terminal bracket. A refrigerant suction pipe 117 to be explained later is coupled to the upper half portion of the cylindrical shell 111, for example, above the drive motor 120.

The upper cap 112 is coupled to cover the open upper end of the cylindrical shell 111.

The lower cap 113 is coupled to cover the lower opening of the cylindrical shell 111. A rim of a high/low pressure separation plate 115 to be explained later is inserted between the cylindrical shell 111 and the upper cap 112 to be welded on the cylindrical shell 111 and the upper cap 112. A rim of a support bracket 116 to be described later is inserted between the cylindrical shell 111 and the lower cap 113 to be welded on the cylindrical shell 111 and the lower cap 113. Accordingly, the inner space of the casing 110 can be sealed.

The high/low pressure separation plate 115 is fixed to the inside of the casing 110 and divides the inside of the casing 110 into the low-pressure part 110*a* forming a suction space and the high-pressure part 110*b* forming a discharge space. Specifically, the rim of the high/low pressure separation plate 115 is welded on the casing 110 as described above. A central portion of the high/low pressure separation plate 115 is bent and protrudes toward an upper surface of the upper cap 112 to be disposed above the back pressure chamber assembly 160 to be described later. A refrigerant suction pipe 117 may communicate with a space below the high/low pressure separation plate 115, and a refrigerant discharge pipe 118 may communicate with a space above the high and low separation plate 115. Accordingly, the low-pressure part 110*a* constituting the suction space may be formed below the high/low pressure separation plate 115, and the high-pressure part 110*b* constituting the discharge space may be formed above the high/low pressure separation plate 115.

The refrigerant suction pipe 117 is coupled through the cylindrical shell 111 in the radial direction. In this case, an outlet 117*a* of the refrigerant suction pipe 117 may be disposed to face the compression unit. For example, the outlet 117*a* of the refrigerant suction pipe 117 may be located between main flange portions 131 of the main frame 130, which will be described later. Accordingly, some of refrigerant suctioned into the low-pressure part 110*a* through the refrigerant suction pipe 117 may move upward to be directly suctioned into the compression chamber V, while the remaining refrigerant may move down toward the motor unit to cool down the drive motor 120 constituting the motor unit. The position where the refrigerant suction pipe 117 is coupled in the penetrating manner will be described later.

The refrigerant discharge pipe 118 is coupled to the upper cap 112 by being inserted through the upper cap 112 in the radial direction. At this time, the outlet 117*a* of the refrigerant suction pipe 117 may be located to face an outer surface of the high/low pressure separation plate 115, more precisely, disposed between an inner circumferential surface of the upper cap 112 and an outer circumferential surface of the high/low pressure separation plate 115. Accordingly, the refrigerant passing through a high/low pressure communication hole 1151*a* of a sealing plate 1151 to be described later may flow along the outer circumferential surface of the high/low pressure separation plate 115 and then flow out of the compressor through the refrigerant discharge pipe 118.

In addition, a through hole 115*a* is formed through a center of the high/low pressure separation plate 115. A sealing plate 1151 from which a floating plate 165 to be described later is detachable is inserted into the through hole 115*a*. The low-pressure part 110*a* and the high-pressure part 110*b* may be blocked from each other by attachment of the floating plate 165 to the sealing plate 1151 or may communicate with each other through a high/low pressure communication hole 1151*a* of the sealing plate 1151.

The sealing plate 1151 may be formed in an annular shape. For example, the high-low pressure communication hole 1151*a* may be formed through a center of the sealing plate 1151 so that the low-pressure part 110*a* and the high-pressure part 110*b* communicate with each other. The floating plate 165 may be detachably coupled along a circumference of the high/low pressure communication hole 1151*a*. Accordingly, the floating plate 165 may be attached to or detached from the circumference of the high/low pressure communication hole 1151*a* of the sealing plate 1151 while moving up and down by back pressure in an axial direction. During this process, the low-pressure part 110*a* and the high-pressure part 110*b* may be sealed from each other or communicate with each other.

In addition, the lower cap 113 defines an oil storage space 110*c* together with the lower half portion of the cylindrical shell 111 that defines the low-pressure part 110*a*. In other words, the oil storage space 110*c* is formed in the lower half portion of the low-pressure part 110*a* and forms a portion of the low-pressure part 110*a*. An oil pickup 126, which will be described later, is immersed in the oil storage space 110*c*, and during the operation of the compressor, oil stored in the oil storage space 110*c* is pumped up by the oil pickup 126 into a sliding part through an oil passage 125*b* of the rotational shaft 125.

Hereinafter, the main frame will be described.

Referring back to FIG. 1, the drive motor 120 according to the embodiment is disposed in the lower half portion of the low-pressure part 110*a* and includes a stator 121 and a rotor 122. The stator 121 is shrink-fitted to an inner wall surface of the cylindrical shell 111, and the rotor 122 is rotatably disposed inside the stator 121. The stator 121 includes a stator core 1211 and a stator coil 1212.

The stator core 1211 is formed in a cylindrical shape, and shrink-fitted to the inner circumferential surface of the cylindrical shell 111. The stator coil 1212 may be wound around the stator core 1211 and may be electrically connected to an external power source through a terminal (not shown) that is coupled through the casing 110.

The rotor 122 includes a rotor core 1221 and permanent magnets 1222. The rotor core 1221 is formed in a cylindrical shape, and is rotatably inserted into the stator core 1211 with a certain gap therebetween. The permanent magnets 1222 are embedded in the rotor core 1222 at preset intervals along a circumferential direction.

In addition, the rotational shaft 125 is press-fitted to a center of the rotor core 1221. An eccentric pin portion 125*a* may be disposed on an upper end of the rotational shaft 125, and an orbiting scroll 150, which will be described later, may be eccentrically coupled to the eccentric pin portion 125*a*. Accordingly, the rotational force of the drive motor 120 may be transmitted to the orbiting scroll 150 through the rotational shaft 125.

On the other hand, a lower end of the rotational shaft 125 is coupled to the rotor 122 and the upper end is coupled to the orbiting scroll 150 to be described later. Accordingly, the rotational force of the drive motor 120 is transmitted to the orbiting scroll 150 through the rotational shaft 125.

An oil passage 125*b* is formed through the inside of the rotational shaft 125, and the oil pickup 126 for suctioning oil stored in the oil storage space 110*c* of the casing 110 is provided in the lower end of the rotational shaft 125. Accordingly, the oil stored in the lower portion of the casing 110 may be suctioned along the oil passage 125*b* of the rotational shaft 125 and move toward an orbiting space portion 133. This oil may then be scattered by pressure difference and/or by collision with a rotational shaft coupling portion, which turns in the orbiting space portion 133, so as to be supplied to bearing surfaces between neighboring members. Various pumps, such as a centrifugal pump, a viscous pump, and a gear pump may be applied as the oil pickup 126. Additionally, FIG. 1 illustrates an example in which a centrifugal pump is applied. Manufacturing costs can be reduced when the centrifugal pump is applied.

Hereinafter, the main frame will be described.

The main frame 130 according to one exemplary embodiment of the present disclosure illustrated in FIG. 1 is fixed inside the casing 110 and disposed in the low-pressure part 110*a*. Specifically, the main frame 130 may be disposed above the drive motor 120 and may be shrink-fitted or welded to an inner wall surface of the cylindrical shell 111.

The main frame 130 according to an embodiment of the present disclosure includes a main flange portion 131, a main bearing portion 132, an orbiting space portion 133, a scroll support portion 134, an Oldham ring support portion 135, and a frame fixing portion 136.

The main flange portion 131 may be formed in an annular shape and accommodated in the low-pressure part 110*a* of the casing 110. An outer diameter of the main flange portion 131 may be formed smaller than an inner diameter of the cylindrical shell 111 so that an outer circumferential surface of the main flange portion 131 is spaced apart from an inner circumferential surface of the cylindrical shell 111. However, the frame fixing portion 136 to be described later protrudes from the outer circumferential surface of the main flange portion 131 in the radial direction. The outer circumferential surface of the frame fixing portion 136 is fixed in close contact with the inner circumferential surface of the casing 110. Accordingly, the main frame 130 is fixedly coupled to the casing 110.

The main bearing portion 132 may protrude downward from a lower surface of a central part of the main flange portion 131 toward the drive motor 120. The main bearing portion 132 has a cylindrical bearing hole 132*a* formed therethrough in the axial direction of the rotational shaft. The rotational shaft 125 is inserted into an inner circumferential surface of the bearing hole 132*a* and supported in the radial direction.

The orbiting space portion 133 is recessed from the center part of the main flange portion 131 toward the main bearing portion 132 to predetermined depth and outer diameter. The orbiting space portion 133 may be formed to be larger than an outer diameter of a rotational shaft coupling portion 153 provided on the orbiting scroll 150 to be described later. Accordingly, the rotational shaft coupling portion 153 may be pivotally accommodated in the orbiting space portion 133.

In addition, oil suctioned through the rotational shaft 125 may be temporarily stored inside the orbiting space portion 133, and this oil may be supplied between the main bearing portion 132 and the rotational shaft 125 and/or between the scroll support portion 134 and the orbiting scroll 150.

The scroll support portion 134 may be formed in an annular shape on an upper surface of the main flange portion 131 along a periphery of the orbiting space portion 133. Accordingly, the scroll support portion 134 supports the lower surface of an orbiting end plate portion 151 to be described later in the axial direction.

The Oldham ring support portion 135 is formed on the outer side of the scroll support portion 134 and has a lower height than the scroll support portion 134. Specifically, the Oldham ring support portion 135 is formed in an annular shape along the outer circumferential surface of the scroll support portion 134 on the upper surface of the main flange portion 131, and is formed at a lower height than the scroll support portion 134. The Oldham ring 170 is placed on the Oldham ring support portion 135 to suppress the rotation of the orbiting scroll 150, which will be described later. Accordingly, the Oldham ring 170 is inserted into the Oldham ring support portion 135 to be pivotable.

The frame fixing portion 136 is formed on the outside of the Oldham ring support portion 135 so that the main frame 130 can be fixed to the casing 110. Specifically, the frame fixing portion 136 extends radially from an outer periphery of the Oldham ring support portion 135.

The frame fixing portion 136 extends in an annular shape or extends to form a plurality of protrusions spaced apart from one another by certain intervals in the circumferential direction. FIG. 1 illustrates an example in which the frame fixing portion 136 has a plurality of protrusions along the circumferential direction.

For example, the plurality of frame fixing portions 136 may be disposed to face guide protrusions 144 of the non-orbiting scroll 140, which will be described later, in the axial direction of the rotational shaft, and each frame fixing portion 136 may include bolt fastening holes 136*a* formed therethrough in the axial direction of the rotational shaft to correspond to guide insertion holes 144*a* of the non-orbiting scroll 140 to be explained later in the axial direction of the rotational shaft.

The inner diameter of the bolt fastening hole 136*a* is smaller than the inner diameter of the guide insertion hole 144*a*. Accordingly, a step surface extending from the inner circumferential surface of the guide insertion hole 144*a* may be formed around the upper surface of the bolt fastening hole 136*a*, and a guide bush 137 which has passed through the guide insertion hole 144*a* may be placed on the step surface so as to be supported on the frame fixing portion 136 in the axial direction of the rotational shaft.

The guide bush 137 may be formed in a cylindrical shape. That is, the guide bush includes a bolt insertion hole 137*h* formed therethrough in the longitudinal direction of the guide bush 137 or in the axial direction of the rotational shaft.

Guide bolts 138 are inserted through the bolt insertion holes 137*h* to be fastened to the bolt fastening holes 136*a* of the frame fixing portion 136, respectively. The non-orbiting scroll 140 is thusly slidably supported on the main frame 130 in the axial direction of the rotational shaft and fixed to the main frame 130 in the radial direction.

Hereinafter, the non-orbiting scroll will be described.

The non-orbiting scroll 140 according to an exemplary embodiment of the present disclosure illustrated in FIG. 1 is disposed on the upper portion of the main frame 130 with an orbiting scroll 150, which will be described later, interposed therebetween. In other words, the non-orbiting scroll 140 is disposed to be movable in the axial direction with respect to one side surface of the main frame 130 with the orbiting scroll 150 interposed therebetween. The non-orbiting scroll 140 is also engaged with the orbiting wrap 150 to define the compression chamber V.

The non-orbiting scroll 140 may be fixedly coupled to the main frame 130 or may be coupled to the main frame 130 to be movable up and down. FIG. 1 illustrates an example in which the non-orbiting scroll 140 is coupled to the main frame 130 to be movable relative to the main frame 130 in the axial direction.

The non-orbiting scroll 140 according to an exemplary embodiment of the present disclosure includes a non-orbiting end plate portion 141, a non-orbiting wrap 142, a non-orbiting side wall portion 143, and a guide protrusion 144.

The non-orbiting end plate portion 141 may be formed in a disk shape and disposed in a horizontal direction in the low-pressure part 110*a* of the casing 110. A discharge port 141*a*, a bypass hole 141*b*, and a scroll-side back pressure hole 141*c* are formed through the central portion of the non-orbiting end plate portion 141 in the axial direction of the rotational shaft.

The discharge port 141*a* is formed at a position where discharge pressure chambers (no reference numeral given) of both compression chambers V formed inside and outside the non-orbiting wrap 142 communicate with each other. The bypass hole 141*b* communicates with the both compression chambers V. The scroll-side back pressure hole 141*c* is spaced apart from the discharge port 141*a* and the bypass hole 141*b*. The scroll-side back pressure hole 141*c* will be described in detail as follows.

Figure 2:
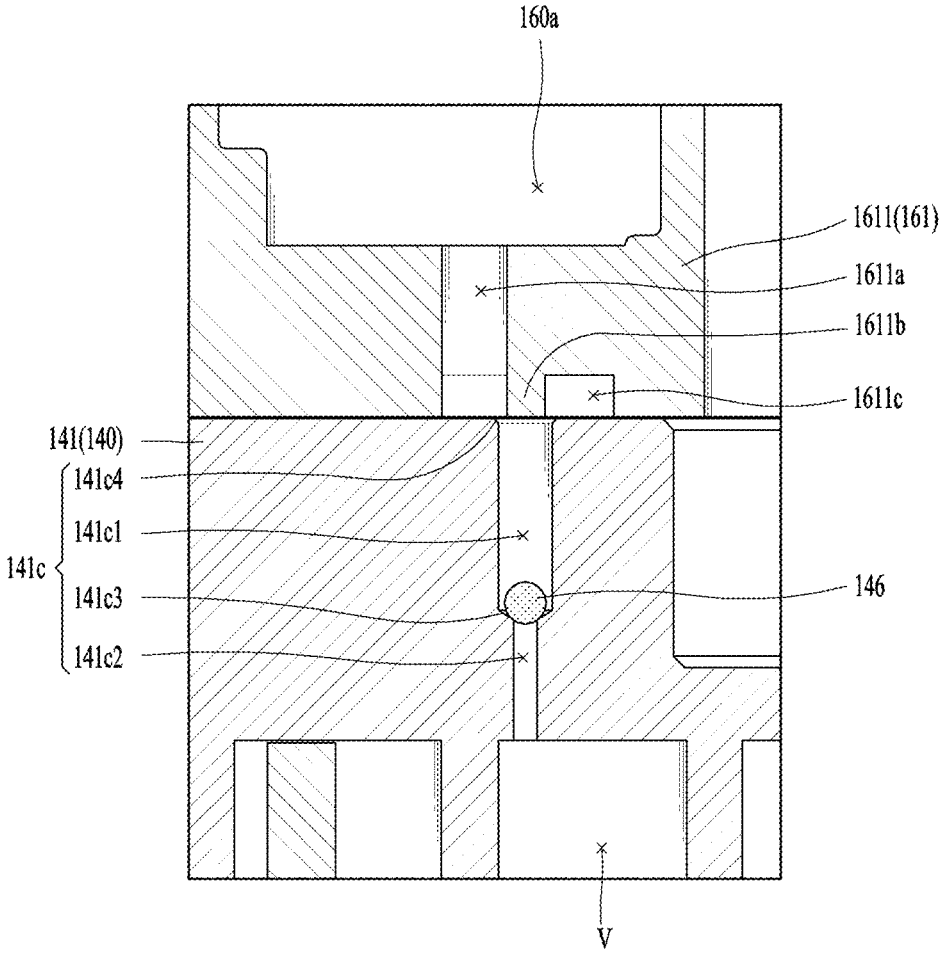
FIG. 2 is a longitudinal sectional view illustrating an exemplary embodiment in which a back pressure valve is disposed inside a scroll-side back pressure hole.
Figure 3:
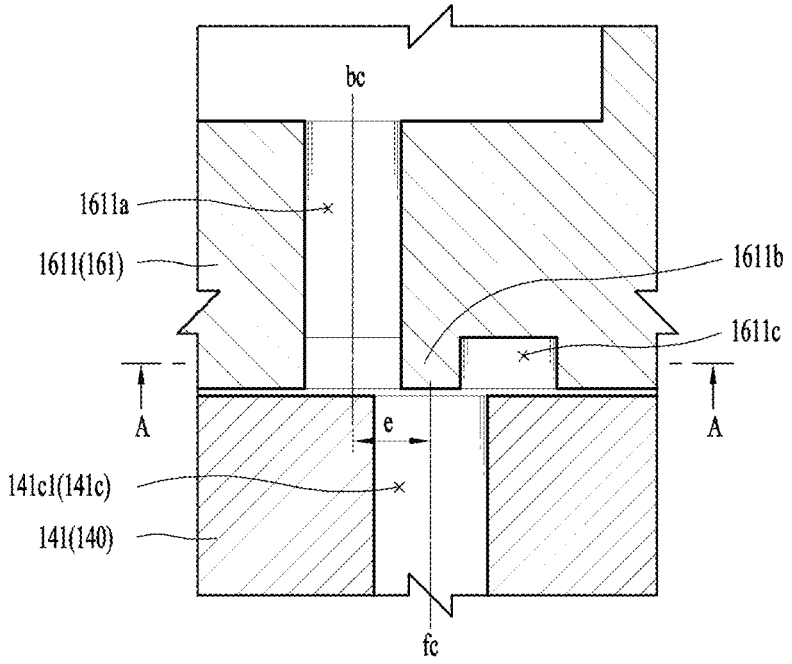
FIG. 3 illustrates an exemplary embodiment in which central axes of a scroll-side back pressure hole and a plate-side back pressure hole are eccentrically disposed.
Figure 5:
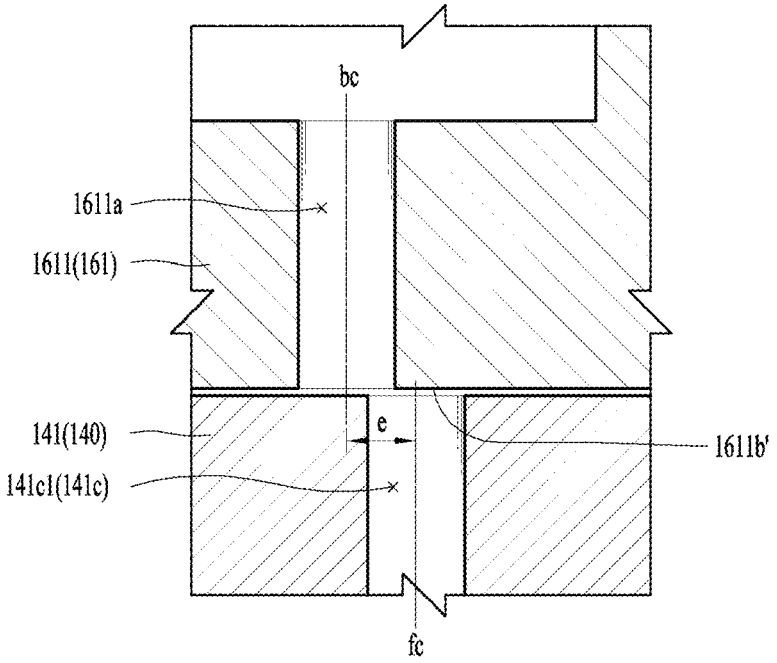
FIG. 5 illustrates another exemplary embodiment in which a connection back pressure groove and a valve limiter of FIG. 3 are not disposed.

As illustrated in FIGS. 2, 3, and 5, the scroll compressor according to an exemplary embodiment of the present disclosure includes a back pressure hole.

The back pressure hole is a refrigerant flow path (passage) that is defined in the non-orbiting scroll 140 and the back pressure chamber assembly 160 to be described later to communicate with the compression chamber V and the back pressure chamber 160*a*, such that compressed refrigerant flows therealong. The compression chamber V is formed together with the non-orbiting scroll 140 and the orbiting scroll 150, and the back pressure chamber 160*a* is formed by a back pressure chamber assembly 160 to be described later, specifically, a back pressure plate 161 and a floating plate 165.

The back pressure hole includes a scroll-side back pressure hole 141*c* formed in the non-orbiting scroll 140 and communicating with the compression chamber V, and a plate-side back pressure hole 1611*a* formed in the back pressure chamber assembly 160 and communicating with the scroll-side back pressure hole 141*c* and the back pressure chamber 160*a*. Hereinafter, the scroll-side back pressure hole 141*c* will be described first, and the plate-side back pressure hole 1611*a* will be explained in detail in relation to the back pressure chamber assembly 160, which will be described later.

The scroll-side back pressure hole 141*c* is a hole that is formed in the non-orbiting scroll 140, specifically, the non-orbiting end plate portion 141 and communicates with the compression chamber V. During the operation of the compressor, compressed refrigerant in the compression chamber V moves to the back pressure chamber 160*a* through the scroll-side back pressure hole 141*c*, and when the compressor stops operating, the refrigerant in the back pressure chamber 160*a* moves to the compression chamber V through the scroll-side back pressure hole 141*c*.

The scroll-side back pressure hole 141*c* communicates with the plate-side back pressure hole 1611*a*, which will be described later, and is formed to penetrate from one surface of the non-orbiting scroll 140 facing the back pressure chamber assembly 160 to the compression chamber V. Here, the one surface of the non-orbiting scroll 140 indicates one surface of the non-orbiting end plate portion 141, and the one surface of the non-orbiting end plate portion 141 is an upper surface facing the back pressure chamber assembly 160.

The scroll-side back pressure hole 141*c* is formed eccentrically from the plate-side back pressure hole 1611*a*, which will be described later, and is formed to communicate with the plate-side back pressure hole 1611*a*. Specifically, a central axis fc of the scroll-side back pressure hole 141*c* is arranged to be spaced apart from a central axis bc of the plate-side back pressure hole 1611*a* by a certain distance e, and the scroll-side back pressure hole 141*c* is formed to communicate with the plate-side back pressure hole 1611*a*. In other words, a portion of the scroll-side back pressure hole 141*c* is formed to communicate with a portion of the plate-side back pressure hole 1611*a*. Accordingly, the back pressure valve 146 to be explained later may move merely inside the scroll-side back pressure hole 141*c* and is limited not to move out of the scroll-side back pressure hole 141*c* toward the plate-side back pressure hole 1611*a*.

The scroll-side back pressure hole 141*c* includes a first scroll-side back pressure hole 141*c*1 communicating with the plate-side back pressure hole 1611*a*, and a second scroll-side back pressure hole 141*c*2 having one end portion communicating with the first scroll-side back pressure hole 141*c*1 and another end portion communicating with the compression chamber V.

Specifically, the first scroll-side back pressure hole 141*c*1 communicates with the plate-side back pressure hole 1611*a*, and is formed (recessed) by a certain depth into one surface of the non-orbiting scroll 140 (specifically, one surface of the non-orbiting end plate portion 141) facing the back-pressure chamber assembly 160. And, the second scroll-side back pressure hole 141*c*2 is formed in a penetrating manner from the first scroll-side back pressure hole 141*c*1 to the compression chamber V.

An inner diameter C1*d* (see FIG. 8) of the first scroll-side back pressure hole 141*c*1 is larger than an inner diameter C2*d* (see FIG. 8) of the second scroll-side back pressure hole 141*c*2, and a step portion 141*c*3 for limiting the movement of the back pressure valve 146 is formed between the first scroll-side back pressure hole 141*c*1 and the second scroll-side back pressure hole 141*c*2. Specifically, the step portion 141*c*3 is formed at a portion where the first scroll-side back pressure hole 141*c*1 and the second scroll-side back pressure hole 141*c*2 are connected, and is inclined toward the second scroll-side back pressure hole 141$c$2. For this reason, the back pressure valve 146 to be explained later is disposed inside the first scroll-side back pressure hole 141$c$1 to be freely movable, and is seated on the step portion 141$c$3 such that its movement toward the second scroll-side back pressure hole 141$c$2 is limited. In addition, since the inner diameter C1$d$ of the first scroll-side back pressure hole 141$c$1 is formed larger than the inner diameter C2$d$ of the second scroll-side back pressure hole 141$c$2, a gap (space) Rd (see FIGS. 8 and 11) between an inner circumferential surface of the first scroll-side back pressure hole 141$c$1 and the back pressure valve 146 can be widened, such that refrigerant can smoothly move through the gap Rd.

Additionally, the first scroll-side back pressure hole 141$c$1 may include a tapered portion 141$c$4 whose one end portion opposite to the step portion 141$c$3 is tapered. By virtue of the tapered portion 141$c$4, the space in which the refrigerant can move can be expanded, allowing the refrigerant to flow smoothly. The tapered portion 141$c$4 may not be formed according to another exemplary embodiment of the present disclosure. FIGS. 3 and 5 illustrate an exemplary embodiment in which one end portion of the first scroll-side back pressure hole 141$c$1 is not tapered. Even if the one end portion of the first scroll-side back pressure hole 141$c$1 is not tapered, if there is a space which is wide enough for the refrigerant to move, the tapered portion 141$c$4 may not be formed. This can reduce manufacturing time of the compressor.

The first scroll-side back pressure hole 141$c$1 and the second scroll-side back pressure hole 141$c$2 are disposed to be eccentric from the plate-side back pressure hole 1611$a$, which will be described later. In other words, one end portion of the scroll-side back pressure hole 141$c$1 is formed eccentrically from the plate-side back pressure hole 1611$a$, and is formed to communicate with the plate-side back pressure hole 1611$a$. Specifically, the central axis fc of the first scroll-side back pressure hole 141$c$1 is arranged to be spaced apart from the central axis bc of the plate-side back pressure hole 1611$a$ by the certain distance e, and one end portion of the first scroll-side back pressure hole 141$c$1 is formed to communicate with the plate-side back pressure hole 1611$a$.

A portion of the scroll-side back pressure hole 141$c$, specifically, a portion of the first scroll-side back pressure hole 141$c$1, is covered with one surface of the back pressure chamber assembly 160, and the back pressure valve 146, which will be described later, axially overlaps one surface 1611$b'$ (see FIG. 5) of the back pressure chamber assembly 160 that covers the first scroll-side back pressure hole 141$c$1. Accordingly, the back pressure valve 146 may move merely inside the first scroll-side back pressure hole 141$c$1 and is limited not to move out of the first scroll-side back pressure hole 141$c$1 toward the plate-side back pressure hole 1611$a$.

The scroll compressor according to the exemplary embodiment of the present disclosure includes the back pressure valve 146 that moves inside the back pressure hole along a longitudinal direction of the back pressure hole by pressure difference between the compression chamber V and the back pressure chamber 160$a$, to vary a passage area of the back pressure hole. Here, the passage area indicates the area of the refrigerant passage through which the refrigerant moves. The back pressure valve 146 may be disposed inside the back pressure hole, and the area of the refrigerant passage may vary while the back pressure valve 146 moves inside the back pressure hole, thereby improving pressure pulsation in the back pressure chamber.

The back pressure valve 146 may be inserted into the back pressure hole (specifically, the scroll-side back pressure hole 141$c$) and may move within the scroll-side back pressure hole 141$c$. The scroll-side back pressure hole 141$c$ indicates the first scroll-side back pressure hole 141$c$1. That is, the back pressure valve 146 may be inserted into the first scroll-side back pressure hole 141$c$1 and may move within the first scroll-side back pressure hole 141$c$1.

The back pressure valve 146 serves to suppress pressure pulsations in the back pressure chamber 160$a$. To explain further, when pressure of the compression chamber V increases as the compressor operates (when pressure of the compression chamber V is higher than pressure of the back pressure chamber 160$a$), the back pressure valve 146 allows the space of the refrigerant passage to be expanded such that the refrigerant compressed in the compression chamber V can easily move to the back pressure chamber 160$a$. In addition, when pressure of the compression chamber V decreases the compressor stops operating (when pressure of the compression chamber V is lower than pressure of the back pressure chamber 160$a$), the back pressure valve 146 allows the space of the refrigerant passage to be reduced such that the compressed refrigerant in the back pressure chamber 160$a$ cannot easily move to the compression chamber V. Therefore, the back pressure valve 146 does not interfere with the pressure increase in the back pressure chamber 160$a$ when the pressure of the compression chamber V increases, and suppresses pressure pulsations in the back pressure chamber 160$a$ when the pressure of the compression chamber V decreases.

Figure 6:
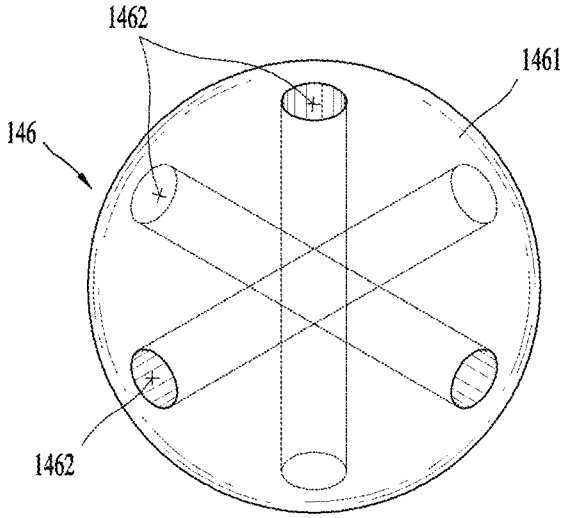
FIG. 6 is a perspective view illustrating an exemplary embodiment in which a refrigerant movement hole is formed in a back pressure valve.
Figure 7:
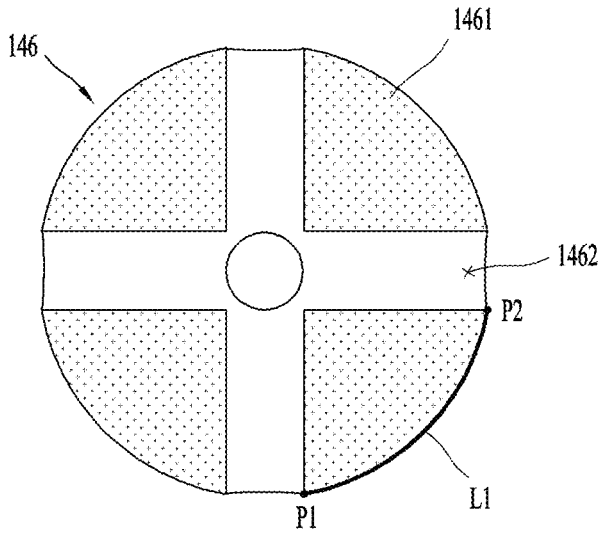
FIG. 7 is a cross-sectional view of the back pressure valve of FIG. 6.
Figure 8:
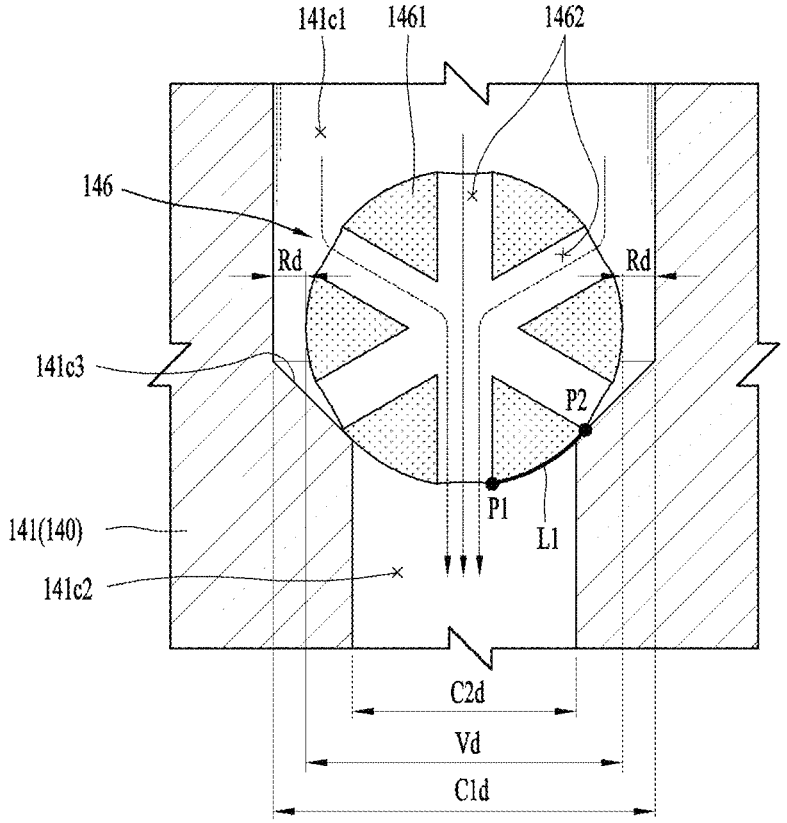
FIG. 8 schematically illustrates an exemplary embodiment in which the back pressure valve of FIG. 6 is placed on a step portion.

As illustrated in FIGS. 6 to 8, the back pressure valve 146 includes a valve body 1461 forming a first refrigerant passage Rd together with the inner circumferential surface of the back pressure hole, and a plurality of refrigerant movement holes 1462 formed through the inside of the valve body 1461 to define a second refrigerant passage. When the pressure of the compression chamber V is higher than the pressure of the back pressure chamber 160$a$, the first refrigerant passage Rd and the second refrigerant passage 1462 are open. On the other hand, when the pressure of the compression chamber V is lower than the pressure of the back pressure chamber 160$a$, the first refrigerant passage Rd is closed and the second refrigerant passage 1462 is open. Here, the first refrigerant passage Rd specifically indicates a gap (space) between the inner circumferential surface of the first scroll-side back pressure hole 141$c$1 and the valve body 1461, and the second refrigerant passage 1462 indicates the plurality of refrigerant movement holes 1462 formed through the inside of the valve body 1461.

The valve body 1461 may be formed in a spherical shape. Here, the spherical shape includes a polyhedron that is close to a spherical shape. The polyhedron close to the spherical shape refers to a polyhedron that is formed to be polyhedral, such as a dodecahedron or an icosahedron, but is close to a spherical shape as a whole.

The valve body 1461 may be made of a plastic material or an elastic material such as rubber. The back pressure valve 146 may collide with the inner circumferential surface of the first scroll-side back pressure hole 141$c$1 or with the back pressure chamber assembly 160 while moving inside the first scroll-side back pressure hole 141$c$1. Since the valve body 1461 is made of a non-metallic material, noise caused by the collision can be reduced, and wear of the inner circumferential surface of the first scroll-side back pressure hole 141$c$1 and the back pressure chamber assembly 160 can be minimized.

The plurality of refrigerant movement holes 1462 are formed to intersect each other. Accordingly, the plurality of refrigerant movement holes 1462 communicate with each other. Due to this, even if one of the plurality of refrigerant movement holes 1462 is blocked by the step portion 141*c*3, etc., the refrigerant can flow into the second scroll-side back pressure hole 141*c*2 through another communicated refrigerant movement hole 1462.

The shortest length of a circumference connecting two refrigerant movement holes 1462 adjacent to each other among the plurality of refrigerant movement holes 1462 (a length L1 of a circumference connecting P1 and P2 in FIG. 7) is shorter than the inner diameter C2*d* of the second scroll-side back pressure hole 141*c*2. Due to this, when the back pressure valve 146 is seated on the step portion 141*c*3, at least one refrigerant movement hole 1462 among the plurality of refrigerant movement holes 1462 may communicate with the second scroll-side back pressure hole 141*c*2, and the compressed refrigerant in the back pressure chamber 160*a* can move to the second scroll-side back pressure hole 141*c*2 through the at least one refrigerant movement hole 1462 formed in the valve body 1461.

The plurality of refrigerant movement holes 1462 may include at least three refrigerant movement holes 1462, and the three refrigerant movement holes 1462 may be formed to be orthogonal to one another. In other words, the plurality of refrigerant movement holes 1462 may be formed in three axial directions that are orthogonal to one another. For this reason, at least one of the plurality of refrigerant movement holes 1462 can communicate with the second scroll-side back pressure hole 141*c*2, so the refrigerant can flow to the second scroll-side back pressure hole 141*c*2 through the communicated refrigerant movement hole 1462. FIGS. 6 to 8 illustrate an embodiment in which three refrigerant movement holes 1462 are formed in the back pressure valve 146 (specifically, the valve body 1461). The three refrigerant movement holes 1462 may be formed to be orthogonal to one another. The shortest length of a circumference connecting two refrigerant movement holes 1462 adjacent to each other among the three refrigerant movement holes 1462 (the shortest length L1 of a circumference connecting P1 and P2 in FIG. 7) is shorter than the inner diameter C2*d* of the second scroll-side back pressure hole 141*c*2.

An outer diameter Vd of the back pressure valve 146 (specifically, the valve body 1461) is smaller than the inner diameter C1*d* of the first scroll-side back pressure hole 141*c*1. Accordingly, a gap (space) is formed between the inner circumferential surface of the first scroll-side back pressure hole 141*c*1 and the valve body 1461, and this defines the first refrigerant passage Rd through which the refrigerant moves. This can facilitate the back pressure valve 146 to move inside the first scroll-side back pressure hole 141*c*1. Also, when the compressor operates and the pressure in the compression chamber V increases, the first refrigerant passage Rd and the second refrigerant passage (the plurality of refrigerant movement holes 1462) can be open, so that the compressed refrigerant in the compression chamber V can smoothly flow toward the back pressure chamber 160*a* through the first refrigerant passage Rd and the second refrigerant passage (the plurality of refrigerant movement holes 1462). Accordingly, the back pressure valve 146 does not interfere with the increase in pressure in the back pressure chamber 160*a*.

According to an exemplary embodiment of the present disclosure, a length obtained by subtracting the outer diameter Vd of the valve body 1461 from the inner diameter C1*d* of the first scroll-side back pressure hole 141*c*1 may be larger than the inner diameter C2*d* of the second scroll-side back pressure hole 141*c*2. Accordingly, the compressed refrigerant in the compression chamber V can move smoothly to the back pressure chamber 160*a* without interference by the back pressure valve 146.

In addition, the outer diameter Vd of the back pressure valve 146 (specifically, the valve body 1461) is larger than the inner diameter C2*d* of the second scroll-side back pressure hole 141*c*2. This can suppress the back pressure valve 146 from moving into the second scroll-side back pressure hole 141*c*2. Then, when the compressor is stopped and the pressure in the compression chamber V is lowered, the back pressure valve 146 is placed on the step portion 141*c*3 and blocks the second scroll-side back pressure hole 141*c*2. At this time, since the first refrigerant passage Rd is closed and the second refrigerant passage is open, the compressed refrigerant in the back pressure chamber 160*a* moves to the compression chamber V through the second refrigerant passage (the plurality of refrigerant movement holes 1462). Accordingly, the flow rate of the refrigerant can be reduced and thus the pressure in the back pressure chamber 160*a* can be slowly lowered, thereby achieving an effect of suppressing (improving) the pressure pulsation in the back pressure chamber 160*a*.

Figure 9:
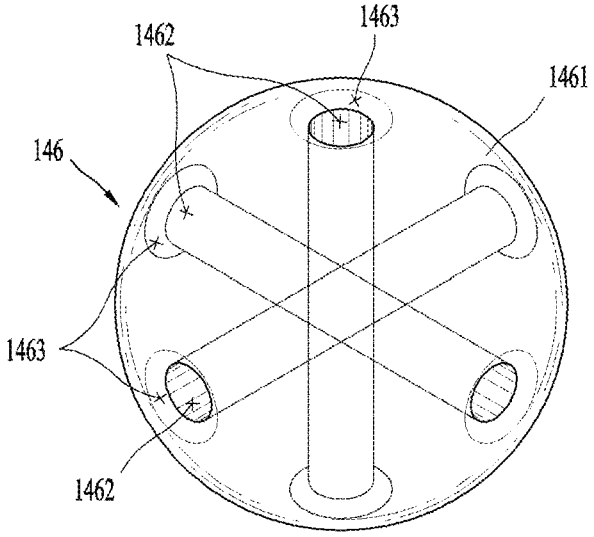
FIG. 9 illustrates another exemplary embodiment in which the back pressure groove of FIG. 6 is further provided with an extension groove.
Figure 10:
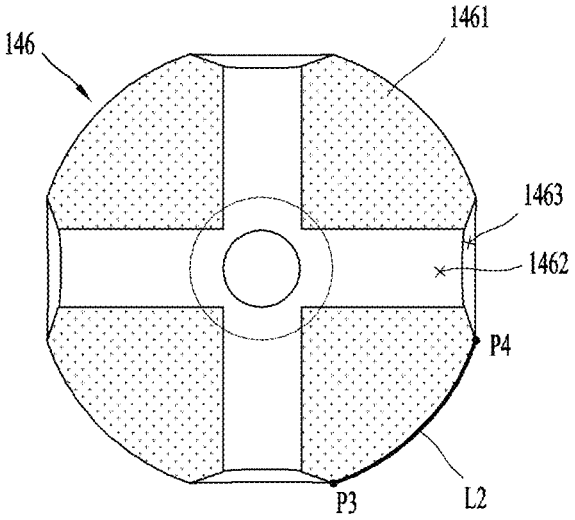
FIG. 10 is a cross-sectional view of the back pressure valve of FIG. 9.
Figure 11:
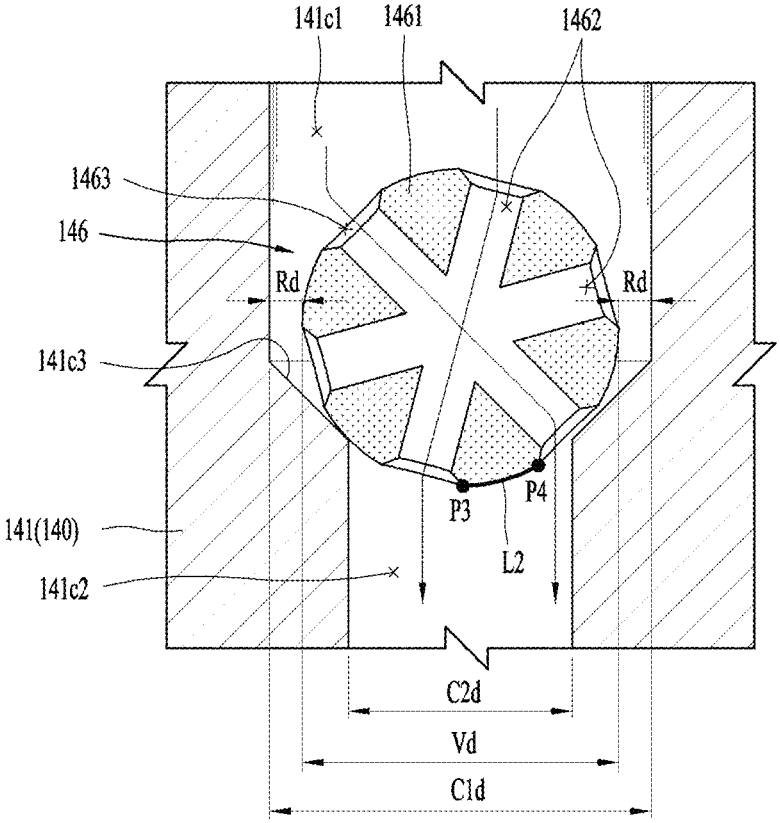
FIG. 11 schematically illustrates an exemplary embodiment in which the back pressure valve of FIG. 9 is placed on the step portion.

In addition, as illustrated in FIGS. 9 to 11, the back pressure valve 146 according to another exemplary embodiment of the present disclosure may further include an expansion groove 1463 formed in an end portion of each of the plurality of refrigerant movement holes 1462 in an expanding manner. The expansion grooves 1463 are formed in both end portions of the refrigerant movement hole 1462 and communicate with the refrigerant movement hole 1462.

The expansion groove 1463 may be formed by tilting the end portion of the refrigerant movement hole 1462 along its outer circumferential surface. Accordingly, the inner diameter at the outermost part of the expansion groove 1463 is formed to be larger than the inner diameter of the refrigerant movement hole 1462. This can facilitate refrigerant, which has passed through the refrigerant movement hole 1462, to move to the outside of the back pressure valve 146 through the expansion groove 1463.

The shortest length of a circumference connecting two adjacent expansion grooves 1463, among the plurality of expansion grooves 1463 formed in the back pressure valve 146 (a length L2 of a circumference connecting P3 and P4 in FIG. 10) is shorter than the inner diameter C2*d* of the second scroll-side back pressure hole 141*c*2. Accordingly, when the back pressure valve 146 is seated on the step portion 141*c*3, at least one expansion groove 1463 among the plurality of expansion grooves 1463 can communicate with the second scroll-side back pressure hole 141*c*2, and the refrigerant introduced into the refrigerant movement hole 1462 can move to the second scroll-side back pressure hole 141*c*2 through the expansion groove 1463.

Meanwhile, in a scroll compressor according to still another exemplary embodiment of the present disclosure, the back pressure valve 146 may be disposed not inside the scroll-side back pressure hole 141*c* as described above, but inside the plate-side back pressure hole 1611*a*. The back pressure valve 146 may move inside the plate-side back pressure hole 1611*a*. A description of this exemplary embodiment will be given in the back pressure chamber assembly 160 to be described later.

The non-orbiting wrap 142 of the non-orbiting scroll 140 extends from a lower surface of the non-orbiting end plate portion 141 facing the orbiting scroll 150 by a set height in the axial direction of the rotational shaft 125, while spirally wrapping several times toward the non-orbiting side wall portion 143 in the vicinity of the discharge port 141*a*. The non-orbiting wrap 142 may be formed to correspond to an orbiting wrap 152 to be described later, to define a pair of compression chambers V together with the orbiting wrap 152.

The non-orbiting side wall portion 143 is formed in an annular shape by extending in the axial direction of the rotational shaft 125 from a lower edge of the non-orbiting end plate portion 141 to surround the non-orbiting wrap 142. A suction port may be formed in the radial direction through one side of the outer circumferential surface of the non-orbiting side wall portion 143.

For example, the suction port may be formed in an arcuate shape that extends between a plurality of guide protrusions 144 to be described later by a preset length in the circumferential direction. Accordingly, refrigerant suctioned through the refrigerant suction pipe 117 can be rapidly suctioned into the suction port via the guide protrusions 144.

The non-orbiting scroll 140 includes guide protrusions 144 that are disposed on one side surface of the main frame 130 with the orbiting scroll 150 interposed therebetween, and extend from an outer circumferential surface (or outer surface) of the main frame 130 in the radial direction, and accordingly is movably supported in the axial direction with respect to the main frame 130.

A guide insertion hole 144*a* is formed through the guide protrusion 144 in the axial direction of the rotational shaft 125, and a guide bush 137 for guiding the axial movement of the non-orbiting scroll 140 is slidably inserted into the guide insertion hole 144*a* and supported by the main frame 130.

The guide protrusion 144 may extend in the radial direction from the lower outer circumferential surface of the non-orbiting side wall portion 143. The guide protrusion 144 may be formed in a single annular shape or may be provided in plurality disposed at certain distances in the circumferential direction. Here, a description will focus on an example in which the plurality of guide protrusions 144 are formed at certain intervals along the circumferential direction.

The guide insertion holes 144*a* are formed through the plurality of guide protrusions 144, respectively, in the axial direction of the rotational shaft 125. The guide insertion holes 144*a* are coaxially located with bolt fastening holes 136*a* formed in the frame fixing portion 136 of the main frame 130.

The guide bushes 137 may be inserted into the guide insertion holes 144*a* to be supported on the upper surface of the frame fixing portion 136 in the axial direction of the rotational shaft 125.

Meanwhile, key grooves into which keys of the Oldham ring 170 are slidably inserted in the radial direction may be formed in some of the guide protrusions 144 among the plurality of guide protrusions 144 (not illustrated).

Hereinafter, the orbiting scroll will be described.

The orbiting scroll 150 is disposed between the main frame 130 and the non-orbiting scroll 140, and performs an orbital motion while being supported by the main frame 130 in the axial direction of the rotational shaft 125. In addition, the orbiting scroll 150 is coupled to the rotational shaft 125 and disposed on the upper surface of the main frame 130. The Oldham ring 170, which is an anti-rotation mechanism, is disposed between the orbiting scroll 150 and the main frame 130. Accordingly, the rotational motion of the orbiting scroll 150 is restricted and the orbiting scroll 150 performs the orbital motion relative to the non-orbiting scroll 140.

The orbiting scroll 150 according to an exemplary embodiment of the present disclosure includes an orbiting end plate portion 151, an orbiting wrap 152, and a rotational shaft coupling portion 153.

The orbiting end plate portion 151 may be formed substantially in a disk shape. The orbiting end plate portion 151 is supported on the scroll support portion 134 of the main frame 130 in the axial direction of the rotational shaft. Accordingly, the orbiting end plate portion 151 and the scroll support portion 134 facing it form an axial bearing surface (a reference numeral not given).

A groove into which another key of the Oldham ring 170 can be slidably inserted may be formed in the lower surface of the orbiting end plate portion 151 (not illustrated).

The orbiting wrap 152 is engaged with the non-orbiting wrap 142 to define the compression chamber V. The orbiting wrap 152 may be formed in a spiral shape by protruding from the upper surface of the orbiting end plate portion 151 facing the non-orbiting scroll 140 to a preset height. The orbiting wrap 152 is formed to correspond to the non-orbiting wrap 142 of the non-orbiting scroll 140 and performs the orbital motion while being engaged with the non-orbiting wrap 142.

The rotational shaft coupling portion 153 protrudes from the lower surface of the orbiting end plate portion 151 toward the main frame 130. The rotational shaft coupling portion 153 may have an inner circumferential surface formed in a cylindrical shape, so that an orbiting bearing (not illustrated) configured as a bush bearing can be press-fitted.

A sliding bush 155 is rotatably inserted into the orbiting bearing, and an eccentric pin portion 125*a* of the rotational shaft 125 is slidably inserted into the sliding bush 155. Accordingly, rotational force of the drive motor 120 can be transmitted to the rotational shaft coupling portion 153 through the eccentric pin portion 125*a* of the rotational shaft 125 and the sliding bush 155. The rotational force transmitted to the rotational shaft coupling portion 153 is restricted by the Oldham ring 170 and the orbiting scroll 150 performs the orbital motion.

At this time, the eccentric pin portion 125*a* and the sliding bush 155 may slide in the radial direction due to a difference between the centrifugal force generated by the orbiting scroll 150 and pressure in the compression chamber V, so that the orbital radius of the orbiting scroll 150 can vary. Through this, when overcompression occurs in the compression chamber V, the overcompression can be solved by allowing leakage between compression chambers V, thereby suppressing damage to the wrap in advance.

Hereinafter, the back pressure chamber assembly will be described.

The back pressure chamber assembly 160 according to the exemplary embodiment of the present disclosure illustrated in FIG. 1 is disposed between the high/low pressure separation plate 115 and the non-orbiting scroll 140, and includes a back pressure chamber 160*a* formed in an annular shape. Specifically, the back pressure chamber assembly 160 is disposed above the non-orbiting scroll 140. Accordingly, back pressure of the back pressure chamber 160*a* (to be precise, force that the back pressure acts on the back pressure chamber) is applied to the non-orbiting scroll 140. In other words, the non-orbiting scroll 140 is pressed toward the orbiting scroll 150 by the back pressure to seal the compression chamber V.

The back pressure chamber assembly 160 according to an exemplary embodiment of the present disclosure includes a back pressure plate 161 and a floating plate 165.

The back pressure plate 161 is coupled to the upper surface of the non-orbiting end plate portion 141. The floating plate 165 is slidably coupled to the back pressure plate 161 to define the back pressure chamber 160*a* together with the back pressure plate 161.

The back pressure plate 161 includes a fixed plate portion 1611, a first annular wall portion 1612, and a second annular wall portion 1613.

The fixed plate portion 1611 is formed in the form of an annular plate with a hollow center.

Referring back to FIGS. 2 to 4, the back pressure chamber assembly 160, specifically, the fixed plate portion 1611 includes a plate-side back pressure hole 1611*a* formed therethrough in the axial direction of the rotational shaft 125, and a connection back pressure groove 1611*c* through which the plate-side back pressure hole 1611*a* and the scroll-side back pressure hole 141*c* communicate with each other.

The plate-side back pressure hole 1611*a* is formed in the back pressure chamber assembly 160, specifically, the fixed plate portion 1611 of the back pressure plate 161, and serves as a refrigerant movement path through which the back pressure chamber 160*a* and the scroll-side back pressure hole 141*c* communicate with each other.

The plate-side back pressure hole 1611*a* is formed through the back pressure chamber 160*a* in the direction in which the non-orbiting scroll 140 is disposed. And, the plate-side back pressure hole 1611*a* communicates with the compression chamber V through the scroll-side back pressure hole 141*c*. Accordingly, the plate-side back pressure hole 1611*a* allows, together with the scroll-side back pressure hole 141*c*, the compression chamber V and the back pressure chamber 160*a* to communicate with each other. During the operation of the compressor, compressed refrigerant in the compression chamber V moves to the back pressure chamber 160*a* sequentially through the scroll-side back pressure hole 141*c* and the plate-side back pressure hole 1611*a*. When the compressor stops operating, the refrigerant in the back pressure chamber 160*a* moves to the compression chamber V sequentially through the plate-side back pressure hole 1611*a* and the scroll-side back pressure hole 141*c*.

The plate-side back pressure hole 1611*a* is formed to penetrate from one surface of the back pressure chamber assembly 160 facing the non-orbiting scroll 140 to the back pressure chamber 160*a*. Here, the one surface of the back pressure chamber assembly 160 indicates one surface of the fixed plate portion 1611, and the one surface is a lower surface facing the non-orbiting scroll 140.

The plate-side back pressure hole 1611*a* is disposed to be eccentric from the scroll-side back pressure hole 141*c*, and is formed to communicate with the scroll-side back pressure hole 141*c*. Referring to FIGS. 3 and 5, the central axis bc of the plate-side back pressure hole 1611*a* is arranged to be spaced apart from the central axis fc of the scroll-side back pressure hole 141*c* by a certain distance e, and the plate-side back pressure hole 1611*a* is formed to communicate with the scroll-side back pressure hole 141*c*. In other words, a portion of the plate-side back pressure hole 1611*a* may be formed to communicate with a portion of the scroll-side back pressure hole 141*c*. Accordingly, the back pressure valve 146 is movable merely inside the scroll-side back pressure hole 141*c* and is limited not to move out of the scroll-side back pressure hole 141*c* toward the back pressure hole 1611*a*.

The connection back pressure groove 1611*c* is formed in the fixed plate portion 1611 of the back pressure plate 161, and serves as a refrigerant movement path through which the plate-side back pressure hole 1611*a* and the scroll-side back pressure hole 141*c* communicate with each other (see FIG. 3). The inner diameter of the connection back pressure groove 1611*c* is formed to be larger than the inner diameter C1*d* of the scroll-side back pressure hole 141*c*. This can expand a space in which the refrigerant can move, thereby enabling a smooth movement of the refrigerant.

The connection back pressure groove 1611*c* is a groove formed in one surface of the fixed plate portion 1611 in the direction in which the high/low pressure separation plate 115 is disposed, and has a certain depth.

Figure 4:
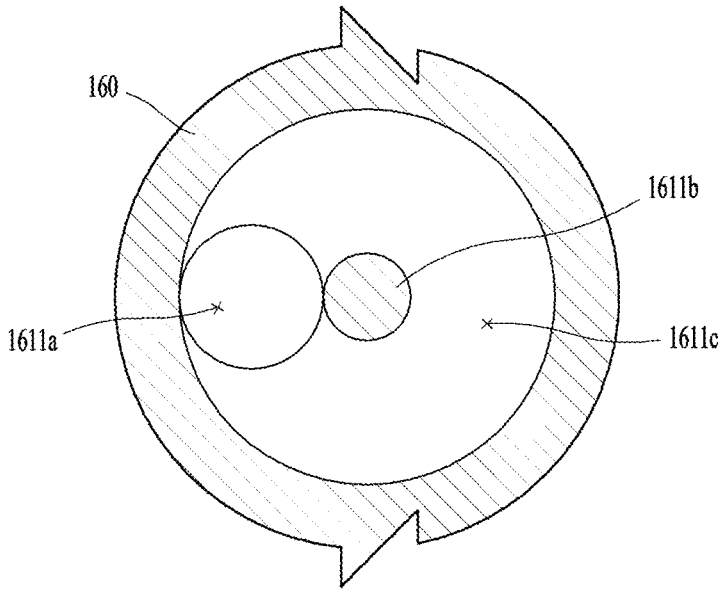
FIG. 4 is a bottom view of a part A-A of FIG. 3.

The connection back pressure hole 1611*c* may have various depths depending on exemplary embodiments. However, with reference to an exemplary embodiment in which a valve limiting portion 1611*b*, which will be described later in FIGS. 2 to 4, is not formed, the depth of the connection back pressure groove 1611*c* may be smaller than the outer diameter of the back pressure valve 146 (specifically, the valve body 1461). Preferably, the depth of the connection back pressure groove 1611*c* may be smaller than the radius of the outer diameter of the valve body 1461. Accordingly, the back pressure valve 146 disposed in the first scroll-side back pressure hole 141*c*1 may be limited not to move toward the plate-side back pressure hole 1611*a* because its movement is limited by the one surface of the connection back pressure groove 1611*c*. At this time, the refrigerant can move to the compression chamber V sequentially through the scroll-side back pressure hole 141*c*, the connection back pressure groove 1611*c*, and the plate-side back pressure hole 1611*a*.

The connection back pressure groove 1611*c* is formed on the same axis with respect to the scroll-side back pressure hole 141*c*, is formed to be eccentric from the plate-side back pressure hole 1611*a*, and communicates with the scroll-side back pressure hole 141*c* and the plate-side back pressure hole 1611*a*. Accordingly, the connection back pressure groove 1611*c* can play the role of a refrigerant passage for moving refrigerant and the role of limiting the movement of the back pressure valve 146.

An end portion of the plate-side back pressure hole 1611*a* opposite to the back pressure chamber 160*a* may be located at a position spaced apart from the center of the connection back pressure groove 1611*c* by a certain distance. For example, the central axis bc of the plate-side back pressure hole 1611*a* may be located at a position spaced apart from the center of the connection back pressure groove 1611*c* by a certain distance e.

The connection back pressure groove 1611*c* is disposed on an upper side of the scroll-side back pressure hole 141*c*. For example, the center of the connection back pressure groove 1611*c* may be located on the same axis as the central axis fc of the scroll-side back pressure hole 141*c*. Accordingly, the central axis bc of the plate-side back pressure hole 1611*a* can be spaced apart (eccentric) from the central axis fc of the scroll-side back pressure hole 141*c* by the certain distance e. That is, the plate-side back pressure hole 1611*a* may be disposed to be eccentric from the scroll-side back pressure hole 141*c*, and may be formed to communicate with the scroll-side back pressure hole 141*c*. However, the center of the connection back pressure groove 1611*c* is not limited to being located on the same axis as the central axis fc of the scroll-side back pressure hole 141*c*, and the center of the connection back pressure groove 1611*c* may not be located on the same axis as the central axis fc of the scroll-side back pressure hole 141*c* as long as the refrigerant can move smoothly through the connection back pressure groove 1611*c*.

According to another exemplary embodiment of the present disclosure, the back pressure chamber assembly 160, specifically, the fixed plate portion 1611 may further include a valve limiting portion 1611*b* formed to protrude on the connection back pressure groove 1611*c*. Specifically, the valve limiting portion 1611*b* may extend from the connection back pressure groove 1611*c* toward the non-orbiting scroll 140 to limit the movement of the back pressure valve 146. Accordingly, the back pressure valve 146 can move inside the scroll-side back pressure hole 141*c* and can be limited not to move toward the plate-side back pressure hole 141*c* by the valve limiting portion 1611*b*.

The height of the valve limiting portion 1611*b* may be smaller than the depth of the connection back pressure groove 1611*c*. Accordingly, a gap (space) between the valve limiting portion 1611*b* and the connection back pressure groove 1611*c* can be expanded, so that the refrigerant can move more smoothly through the gap.

Alternatively, the height of the valve limiting portion 1611*b* may be equal to the depth of the connection back pressure groove 1611*c*. Accordingly, the valve limiting portion 1611*b* can reduce a movable distance of the back pressure valve 146 and limit the movement of the back pressure valve 146. The reduction of the movable distance of the back pressure valve 146 may also result in minimizing wear on the inner circumferential surface of the scroll-side back pressure hole 141*c* and the back pressure chamber assembly 160.

In an exemplary embodiment of the present disclosure in which the center of the connection back pressure groove 1611*c* is located on the same axis as the central axis fc of the scroll-side back pressure hole 141*c*, the valve limiting portion 1611*b* may be formed to protrude a certain length from the center of the connection back pressure groove 1611*c* in the direction in which the non-orbiting scroll 140 is disposed. Accordingly, the back pressure valve 146 can move merely inside the back pressure hole 141*c*, specifically, the first scroll-side back pressure hole 141*c*1, and is limited not to move out of the first scroll-side back pressure hole 141*c*1 toward the connection back pressure groove 1611 and the plate-side back pressure hole 1611*a*. However, the position where the valve limiting portion 1611*b* is formed may not be limited to the center of the connection back pressure groove 1611*c* and may be formed at anywhere inside the connection back pressure groove 1611*c* as long as the valve limiting portion 1611*b* can limit the movement of the back pressure valve 146. Accordingly, the efficiency of selecting the placement position of the valve limiting portion 1611*b* can be improved.

Figure 12:
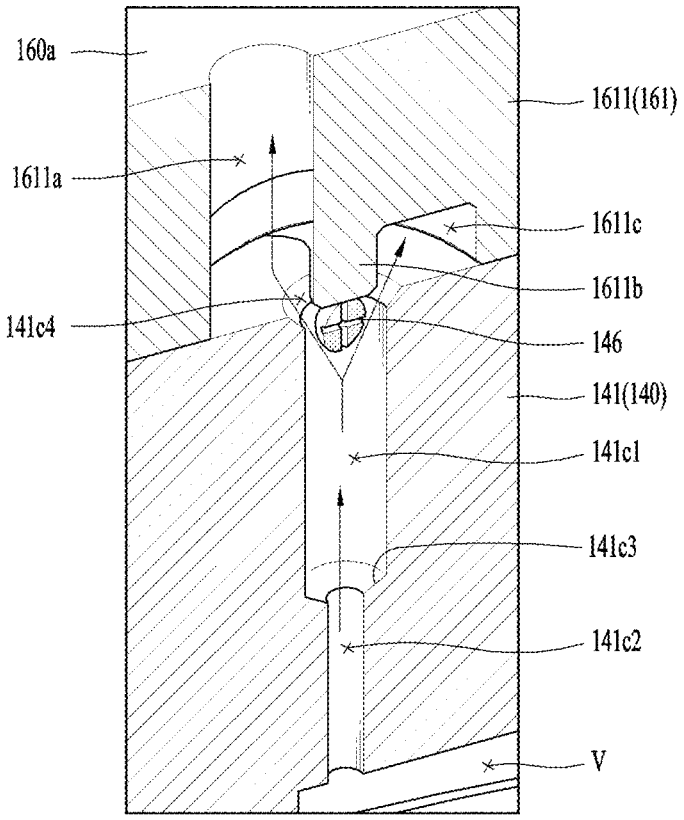
FIG. 12 illustrates the position of a back pressure valve and the movement path of refrigerant when pressure in a compression chamber increases according to an exemplary embodiment of the present disclosure.
Figure 13:
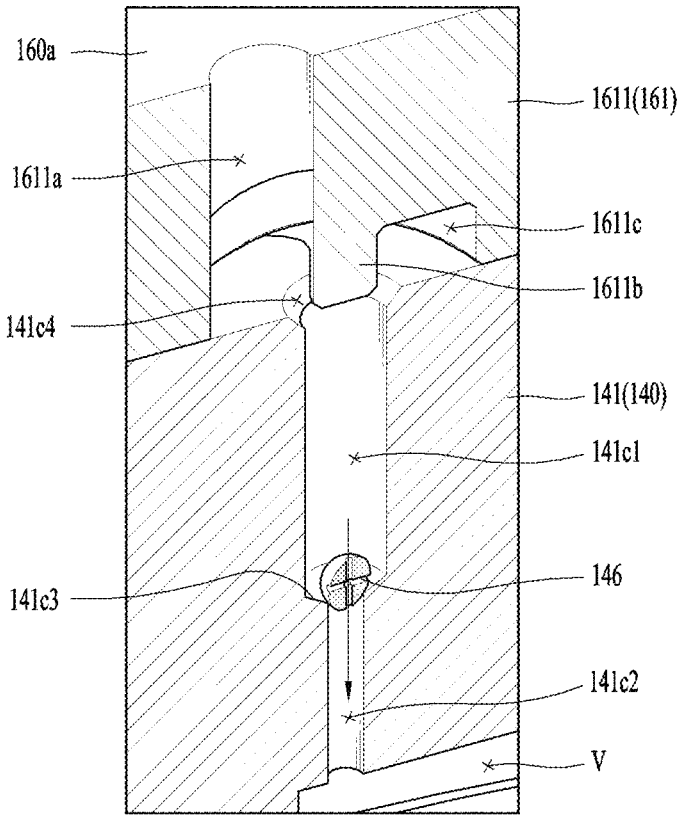
FIG. 13 illustrates the position of the back pressure valve and the movement path of the refrigerant when pressure in the compression chamber decreases according to an exemplary embodiment of the present disclosure.

Hereinafter, a position to which the back pressure valve 146 moves will be described with reference to FIGS. 12 and 13.

When the compressor operates and pressure of the compression chamber V increases (when pressure of the compression chamber V is higher than pressure of the back pressure chamber 160*a*), the back pressure valve 146 can move inside the scroll-side back pressure hole 141*c*1, but may be limited not to move toward the connection back pressure groove 1611 and the plate-side back pressure hole 1611*a* due to the valve limiting portion 1611*b*. At this time, the compressed refrigerant in the compression chamber V can flow smoothly toward the back pressure chamber 160*a* through the gap (the first refrigerant passage Rd) between the back pressure valve 146 and the inner circumferential surface of the first scroll-side back pressure hole 141*c*1 and the plurality of refrigerant movement holes (the second refrigerant passage 1462) formed in the back pressure valve 146.

Also, when the compressor stops and the pressure of the compression chamber V decreases (when the pressure of the compression chamber V is lower than the pressure of the back pressure chamber 160*a*), the back pressure valve 146 can move inside the first scroll-side back pressure hole 141*c*1, but may be limited not to move toward the second scroll-side back pressure hole 141*c*2 due to being seated on the step portion 141*c*3. At this time, the compressed refrigerant in the back pressure chamber 160*a* moves to the compression chamber V through the plurality of refrigerant movement holes (the second refrigerant passage 1462) formed in the back pressure valve 146. Accordingly, the flow rate of the refrigerant flowing toward the compression chamber V can be reduced and thus the pressure in the back pressure chamber 160*a* can be slowly lowered, thereby achieving an effect of suppressing (improving) the pressure pulsation in the back pressure chamber 160*a*.

Meanwhile, according to another exemplary embodiment of the present disclosure, the connection back pressure groove 1611*c* and the valve limiting portion 1611*b* may not be formed. FIG. 5 illustrates an exemplary embodiment of the present disclosure in which the connection back pressure groove 1611*c* and the valve limiting portion 1611*b* are not formed. Since the connection back pressure groove 1611*c* and the valve limiting portion 1611*b* are not formed, the manufacturing cost and manufacturing time of the compressor can be saved. In this exemplary embodiment, a portion of the scroll-side back pressure hole 141*c*, specifically, a portion of the first scroll-side back pressure hole 141*c*1, is covered with one surface of the back pressure chamber assembly 161, and the back pressure valve 146 axially overlaps one surface 1611*b*' of the back pressure plate 161 that covers the first scroll-side back pressure hole 141*c*1. Accordingly, since the movement of the back pressure valve 146 is limited by the one surface 1611*b*' of the back pressure plate 161, the back pressure valve 146 can move only inside the first scroll-side back pressure hole 146, and cannot move out of the first scroll-side back pressure hole 141*c*1 toward the plate-side back pressure hole 1611*a*. Here, the one surface 1611*b*' of the back pressure plate 161 covering the first scroll-side back pressure hole 141*c*1, which serves as the valve limiting portion, indicates one surface 1611*b*' of the fixed plate portion 1611.

Figure 14:
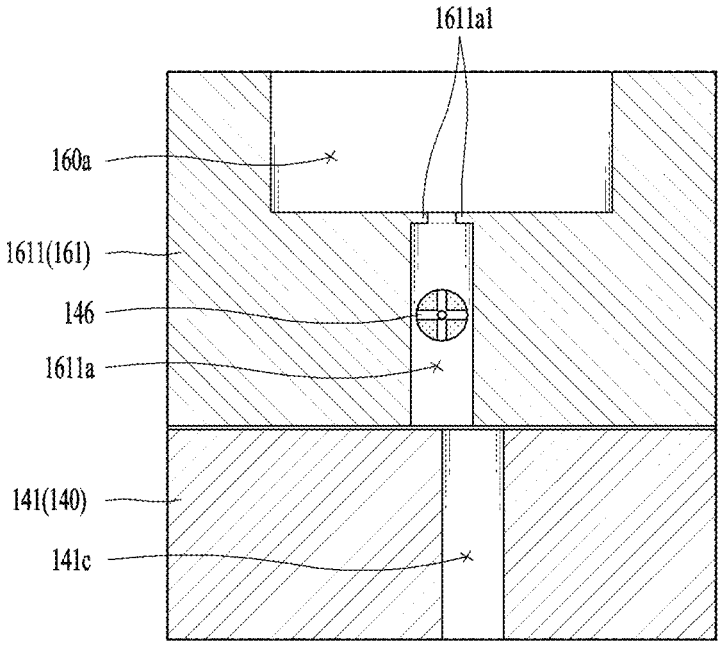
FIG. 14 is a longitudinal sectional view schematically illustrating another exemplary embodiment in which a back pressure valve is disposed inside a plate-side back pressure hole.
Figure 15:
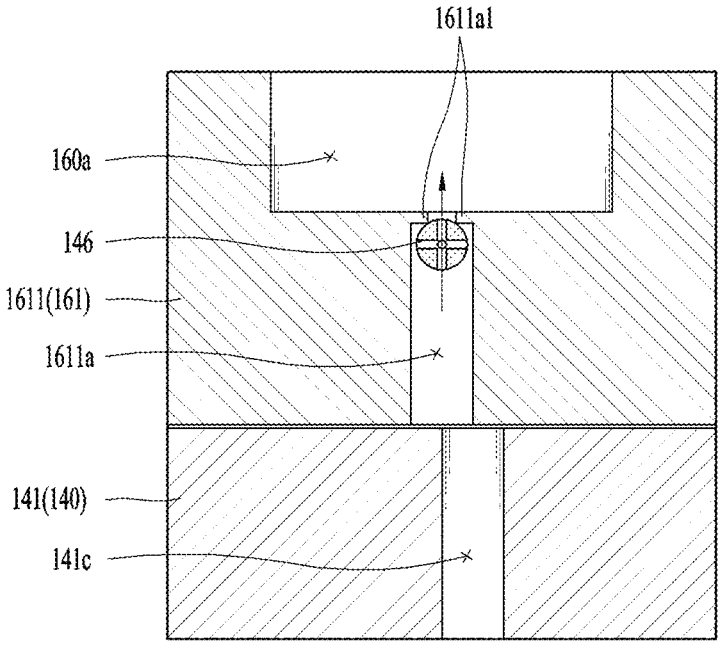
FIG. 15 schematically illustrates the position of the back pressure valve of FIG. 14 and the movement path of refrigerant when pressure in a compression chamber increases.
Figure 16:
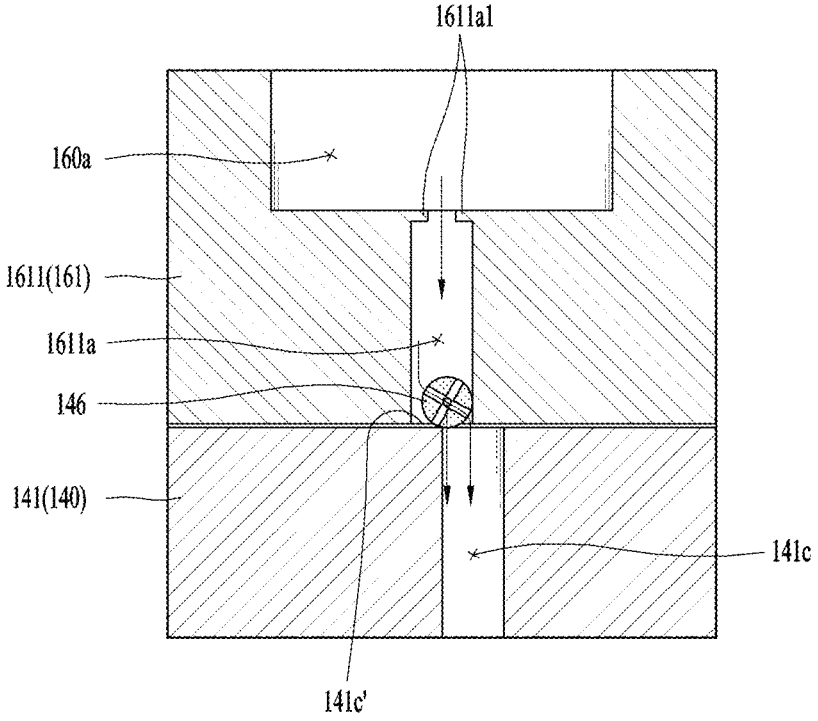
FIG. 16 schematically illustrates the position of the back pressure valve of FIG. 14 and the movement path of refrigerant when pressure in the compression chamber decreases.

Meanwhile, in a scroll compressor according to still another embodiment of the present disclosure, the back pressure valve 146 may be disposed not inside the scroll-side back pressure hole 141*c* as described above, but inside the plate-side back pressure hole 1611*a*. The back pressure valve 146 may move inside the plate-side back pressure hole 1611*a*. FIGS. 14 to 16 illustrate still another exemplary embodiment in which the back pressure valve 146 is disposed inside the plate-side back pressure hole 1611*a*.

When compared to the scroll compressor according to the exemplary embodiments of the present disclosure illustrated in FIGS. 1 to 13, the scroll compressor according to still another exemplary embodiment of the present disclosure illustrated in FIGS. 14 to 16 has a difference merely in that the back pressure valve 146 is disposed inside the plate-side back pressure hole 1611*a* and a plate-side valve limiting portion 1611*a*1 is formed in the plate-side back pressure hole 1611*a*. Therefore, other configurations of the scroll compressor according to the still another exemplary embodiment of the present disclosure illustrated in FIGS. 14 to 16 are the same as those of the scroll compressor according to the exemplary embodiments of the present disclosure illustrated in FIGS. 1 to 13, a detailed description thereof will be replaced with the previous description.

Referring to FIGS. 14 to 16, the back pressure valve 146 may be disposed inside the plate-side back pressure hole 1611*a*. The back pressure valve 146 may move inside the plate-side back pressure hole 1611*a*.

A plate-side valve limiting portion 1611*a*1 for limiting the movement of the back pressure valve 146 protrudes from one end portion, opposite to the scroll-side back pressure hole 141*c*, of both end portions of the plate-side back pressure hole 1611*a*.

The inner diameter of the plate-side valve limiting portion 1611*a*1 is smaller than the outer diameter of the back pressure valve 146. Accordingly, the back pressure valve 146 cannot move out of the plate-side back pressure hole 1611*a* toward the back pressure chamber 160*a*.

The outer diameter Vd of the back pressure valve 146 (specifically, the valve body 1461) is smaller than the inner diameter C1*d* of the plate-side back pressure hole 1611*a*. This can facilitate the back pressure valve 146 to move inside the plate-side back pressure hole 1611*a*.

And, when the compressor operates and pressure of the compression chamber V increases (when pressure of the compression chamber V is higher than pressure of the back pressure chamber 160*a*), the movement of the back pressure valve 146 may be limited by the plate-side valve limiting portion 1611*a*1, and the compressed refrigerant in the compression chamber V may smoothly move to the back pressure chamber 160*a* through the gap between the back pressure valve 146 (specifically, the valve body 1461) and the inner surface of the plate-side back pressure hole 1611*a* and the refrigerant movement holes 1462.

Also, the central axis bc of the plate-side back pressure hole 1611*a* may be arranged to be spaced apart (eccentric) from the central axis fc of the scroll-side back pressure hole 141*c* by a certain distance e, and the plate-side back pressure hole 1611*a* may be formed to communicate with the scroll-side back pressure hole 141*c*. In other words, another end portion of the plate-side back pressure hole 1611*a* may be formed to communicate with a portion of the scroll-side back pressure hole 141*c*, and the movement of the back pressure valve 146 may be limited by the non-orbiting scroll 140 (specifically, one surface 141*c*' of the non-orbiting end plate portion 141) that covers a portion of the another end portion of the plate-side back pressure hole 1611*a*. Accordingly, the back pressure valve 146 can move merely inside the plate-side back pressure hole 1611*a* and can be limited not to move out of the plate-side back pressure hole 1611*a* toward the scroll-side back pressure hole 141*c*.

And, when the compressor is stopped and pressure of the compression chamber V decreases (when pressure of the back pressure chamber 160*a* is higher than pressure of the compression chamber V), the back pressure valve 146 is placed on one surface 141*c*' of the non-orbiting scroll 140 (specifically, the non-orbiting end plate portion 141) and closes the scroll-side back pressure hole 141*c*. At this time, the compressed refrigerant in the back pressure chamber 160*a* moves to the compression chamber V through the plurality of refrigerant movement holes 1462 formed in the valve body 1461. Accordingly, the flow rate of the refrigerant flowing toward the compression chamber V can be reduced and thus the pressure in the back pressure chamber 160*a* can be slowly lowered, thereby achieving an effect of suppressing (improving) the pressure pulsation in the back pressure chamber 160*a*.

Meanwhile, the first annular wall portion 1612 and the second annular wall portion 1613 are formed on an upper surface of the fixed plate portion 1611 to surround inner and outer circumferential surfaces of the fixed plate portion 1611. Accordingly, an outer circumferential surface of the first annular wall portion 1612, an inner circumferential surface of the second annular wall portion 1613, the upper surface of the fixed plate portion 1611, and a lower surface of the floating plate 165 define the back pressure chamber 160*a* in the annular shape.

The first annular wall portion 1612 includes an intermediate discharge port 1612*a* that communicates with the discharge port 141*a* of the non-orbiting scroll 140. A valve guide groove 1612*b* into which a check valve (hereinafter, referred to as a discharge valve) 145 is slidably inserted is formed inside the intermediate discharge port 1612*a*. A backflow prevention hole 1612*c* is formed in a central portion of the valve guide groove 1612*b*. Accordingly, the check valve 145 is selectively open and closed between the discharge port 141*a* and the intermediate discharge port 1612*a* to suppress a discharged refrigerant from flowing back into the compression chamber.

The floating plate 165 may be formed in an annular shape and may be formed of a lighter material than the back pressure plate 161. Accordingly, the floating plate 165 is detachably coupled to a lower surface of the high/low pressure separation plate 115 while moving in the axial direction of the rotational shaft with respect to the back pressure plate 161 depending on pressure of the back pressure chamber 160*a*. For example, when the floating plate 165 is brought into contact with the high/low pressure separation plate 115, the floating plate 165 serves to seal the low-pressure part 110*a* such that the discharged refrigerant is discharged to the high-pressure part 110*b* without leaking into the low-pressure part 110*a*.

The scroll compressor according to the exemplary embodiments of the present disclosure operates as follows.

When power is applied to the stator coil 1212 of the stator 121, the rotor 122 rotates together with the rotational shaft 125. Then, the orbiting scroll 150 coupled to the rotational shaft 125 performs the orbital motion with respect to the non-orbiting scroll 140, forming a pair of compression chambers V between the orbiting wrap 152 and the non-orbiting wrap 142.

The compression chambers V gradually decrease in volume while moving from outside to inside according to the orbital motion of the orbiting scroll 150. At this time, the refrigerant is suctioned into the low-pressure part 110*a* of the casing 110 through the refrigerant suction pipe 117. Some of this refrigerant are suctioned directly into the suction pressure chambers (no reference numeral given) of the both compression chambers V, respectively, while the remaining refrigerant first flows toward the drive motor 120 and then is suctioned into the suction pressure chambers (reference numeral not given).

The refrigerant suctioned into each suction pressure chamber (reference numeral not given) is compressed while moving toward the intermediate pressure chamber and discharge pressure chamber (reference numerals not given) along a movement path of the compression chamber V. The refrigerant moved to the discharge pressure chamber (reference numeral not given) is then discharged to the high-pressure part 110*b* through the discharge port 141*a* and the intermediate discharge port 1612*a* while pushing the discharge valve 145. The refrigerant is filled in the high-pressure part 110*b* and then discharged through a condenser of a refrigeration cycle via the refrigerant discharge pipe 118. The series of processes are repetitively carried out.

At this time, a portion of the refrigerant compressed while passing through the intermediate compression chamber (reference numeral not given) may be bypassed in advance toward the high-pressure part 110*b* from the intermediate pressure chamber (reference numeral not given), defining each compression chamber, through the bypass hole 141*b* before reaching the discharge port 141*a*. This can suppress the refrigerant from being overcompressed over a preset pressure or more in the compression chamber.

In addition, another portion of the refrigerant compressed while passing through the intermediate pressure chamber (reference numeral not given) flows even into the back pressure chamber 160*a* through the scroll-side back pressure hole 141*c* before reaching the discharge port 141*a*, so that the back pressure chamber 160*a* forms intermediate pressure. Responsive to this, the floating plate 165 move up toward the high/low pressure separation plate 115 to be in close contact with the sealing plate 1151 disposed on the high/low pressure separation plate 115. The back pressure plate 161 is pressed down toward the non-orbiting scroll 140 by pressure of the back pressure chamber 160*a*, so as to push the non-orbiting scroll 140 toward the orbiting scroll 150.

As the floating plate 165 moves up to be brought into close contact with the sealing plate 1151, the high-pressure part 110*b* of the casing 110 may be separated from the low-pressure part 110*a*, so as to suppress the refrigerant discharged from each compression chamber V to the high-pressure part 110*b* from flowing back into the low-pressure part 110*a*. On the other hand, as the back pressure plate 161 is moved down toward the non-orbiting scroll 140, the non-orbiting scroll 140 may be brought into close contact with the orbiting scroll 150, so as to suppress the compressed refrigerant from leaking into a low-pressure side compression chamber from a high-pressure side compression chamber forming the intermediate pressure chamber.

During the operation of the scroll compressor, the related scroll compressor does not have a component for adjusting back pressure in a refrigerant passage communicating between the compression chamber V and the back pressure chamber 160*a*. This continuously causes pulsation in the back pressure chamber 160*a*.

Therefore, the scroll compressor according to the exemplary embodiments of the present disclosure may include the back pressure valve 146 that is disposed in the scroll-side back pressure hole 141*c* or the plate-side back pressure hole 1611*a*, which serves as the refrigerant passage, to vary the passage area of the scroll-side back pressure hole 141*c* or the plate-side back pressure hole 1611*a*. Accordingly, when the compressor is stopped and pressure of the compression chamber V decreases, the compressed refrigerant in the back pressure chamber 160*a* can move to the compression chamber V through the refrigerant movement holes 1462 of the back pressure valve 146, thereby suppressing (improving) pressure pulsation in the back pressure chamber 160*a*.

Figure 17:
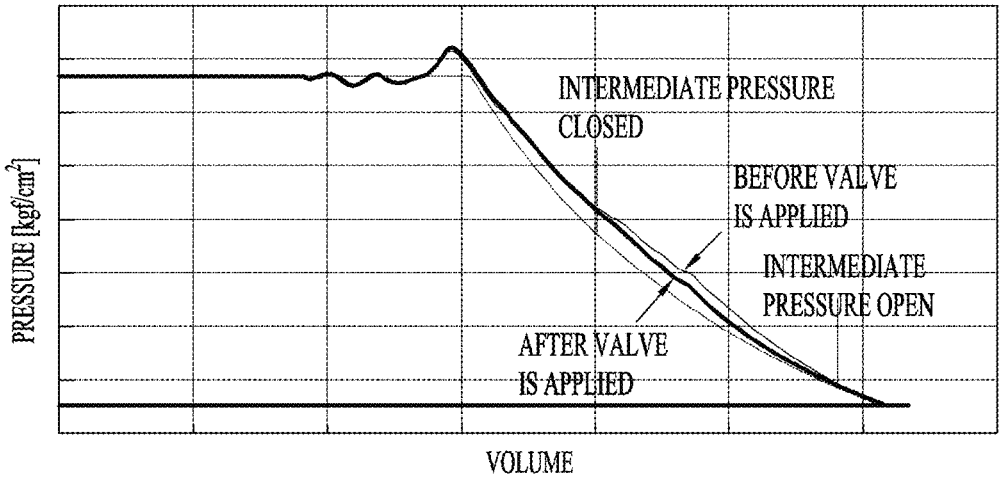
FIG. 17 is a view illustrating a change in pressure in a back pressure chamber of a scroll compressor to which a back pressure valve of the present disclosure is applied and a back pressure chamber in a scroll compressor to which the back pressure valve is not applied.
Figure 18:
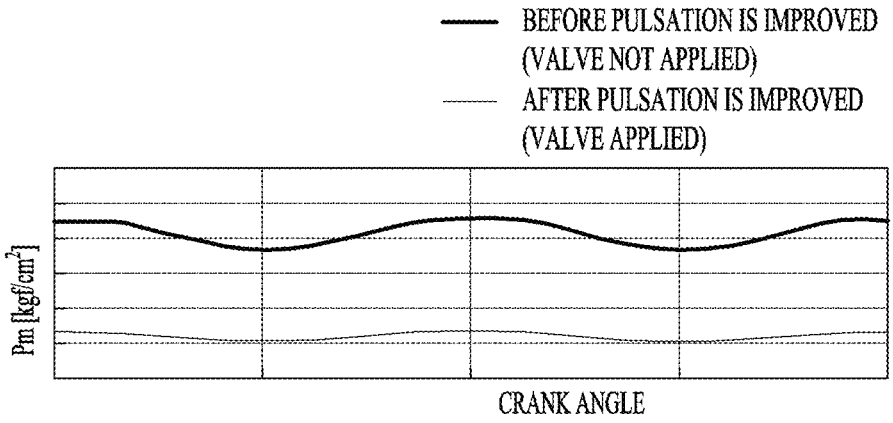
FIG. 18 illustrates pressure changes according to a crank angle in FIG. 17.

FIGS. 17 and 18 illustrate pressure pulsations of a scroll compressor to which the back pressure valve 146 of the present disclosure is applied. More precisely, it is shown that the pulsation in the back pressure chamber 160*a* is improved during the operation of the scroll compressor according to the exemplary embodiment in which the back pressure valve 146 is disposed in the scroll-side back pressure hole 141*c* (specifically, the first scroll-side back pressure hole 141*c*1).

Referring to FIGS. 17 and 18, it can be seen that in a section where intermediate pressure is closed and open, pressure in the back pressure valve 160*a* when the back pressure valve 146 is applied is lower than that when the back pressure valve 146 is not applied, and accordingly, the amplitude of pressure in the back pressure chamber 160*a* according to a crank angle can be lowered so as to suppress pressure pulsation.

[Description of Reference numerals]

| | |
|---|---|
| 110: Casing | 110a: Low-pressure part (suction space) |
| 110b: High-pressure part (discharge space) | 110c: Oil storage space |
| 111: Cylindrical shell | 112: Upper cap |
| 113: Lower cap | 115: High/low pressure separation plate |
| 115a: Through hole | 1151: Sealing plate |
| 1151a: High/low pressure communication hole | 117: Refrigerant suction pipe |
| 117a: Outlet of refrigerant suction pipe | 118: Refrigerant discharge pipe |
| 120: Drive motor | 121: Stator |
| 1211: Stator core | 1212: Stator coil |
| 122: Rotor | 1221: Rotor core |
| 1222: Permanent magnet | 125: Rotational shaft |
| 125a: Eccentric pin portion | 125b: Oil passage |
| 126: Oil pickup | 130: Main frame |
| 131: Main flange portion | |
| 132: Main bearing portion | 132a: Bearing hole |
| 133: Orbiting space portion | 134: Scroll support portion |
| 135: Oldham ring support portion | 136: Frame fixing portion |
| 136a: Bolt fastening hole | 137: Guide bush |
| 137h: Bolt insertion hole | 138: Guide bolt |
| 140: Non-orbiting scroll | 141: Non-orbiting end plate portion |
| 141a: Discharge port | 141b: Bypass hole |
| 141c: Scroll-side back pressure hole | 141c1: First scroll-side back pressure hole |
| 141c2: Second scroll-side back pressure hole | |
| 141c3: Step portion | 141c4: Tapered portion |
| 142: Non-orbiting wrap | 143: Non-orbiting side wall portion |
| 144: Guide protrusion | 144a: Guide insertion hole |
| 145: Discharge valve | 146: Back pressure valve |
| 1461: Valve body | 1462: Refrigerant movement hole |
| 1463: Extension groove | 150: Orbiting scroll |
| 151: Orbiting end plate portion | 152: Orbiting wrap |
| 153: Rotational shaft coupling portion | 155: Sliding bush |
| 160: Back pressure chamber assembly | 160a: Back pressure chamber |
| 161: Back pressure plate | 1611: Fixed plate portion |

-continued

| [Description of Reference numerals] | |
|---|---|
| 1611a: Plate-side back pressure hole | 1611a1: Plate-side valve limiting portion |
| 1611b: Valve limiting portion | 1611c: Connection back pressure groove |
| 1612: First annular wall portion | 1612a: Intermediate discharge port |
| 1612b: Valve guide groove | 1612c: Backflow prevention hole |
| 1613: Second annular wall portion | 165: Floating plate |
| 170: Oldham ring | V: Compression chamber |

The invention claimed is:

1. A scroll compressor comprising:

a casing;

a high/low pressure separation plate that is fixed inside of the casing and divides the inside of the casing into a low-pressure portion forming a suction space and a high-pressure portion forming a discharge space;

a main frame that is fixed inside of the casing and disposed in the low-pressure portion;

an orbiting scroll that is supported on the main frame in an axial direction to perform an orbital motion;

a non-orbiting scroll that is movable in the axial direction with respect to one side surface of the main frame with the orbiting scroll disposed therebetween, and forms a compression chamber together with the orbiting scroll;

a back pressure chamber assembly that is disposed between the high/low pressure separation plate and the non-orbiting scroll and comprises a back pressure chamber formed in an annular shape; and a back pressure hole that is disposed in the non-orbiting scroll and the back pressure chamber assembly, such that the compression chamber and the back pressure chamber communicate with each other, wherein a back pressure valve is disposed inside of the back pressure hole, the back pressure valve moving along a longitudinal direction of the back pressure hole due to a pressure difference between the compression chamber and the back pressure chamber to vary a passage area of the back pressure hole, wherein the back pressure valve comprises:

a valve body that forms a first refrigerant passage together with an inner circumferential surface of the back pressure hole; and a plurality of refrigerant movement holes that are formed through an inside of the valve body to form a second refrigerant passage, and wherein the valve body is formed in a spherical shape, and the plurality of refrigerant movement holes are formed to intersect one another.

2. The scroll compressor of claim 1, wherein the plurality of refrigerant movement holes are formed along three axial directions orthogonal to one another.

3. The scroll compressor of claim 1, wherein the first refrigerant passage and the second refrigerant passage are open when the pressure of the compression chamber is higher than the pressure of the back pressure chamber, and the first refrigerant passage is closed and the second refrigerant passage is open when the pressure of the compression chamber is lower than the pressure of the back pressure chamber.

4. The scroll compressor of claim 3, wherein the back pressure hole comprises a scroll-side back pressure hole that is formed in the non-orbiting scroll and communicates with the compression chamber, and a plate-side back pressure hole that is formed in the back pressure chamber assembly and communicates with the scroll-side back pressure hole and the back pressure chamber, wherein the scroll-side back pressure hole and the plate-side back pressure hole are formed eccentrically from each other, and wherein the back pressure valve is disposed inside of the scroll-side back pressure hole.

5. The scroll compressor of claim 4, wherein the scroll-side back pressure hole comprises a first scroll-side back pressure hole that communicates with the plate-side back pressure hole, and a second scroll-side back pressure hole having a first end portion that communicates with the first scroll-side back pressure hole and a second end portion that communicates with the compression chamber, wherein an inner diameter of the first scroll-side back pressure hole is larger than an inner diameter of the second scroll-side back pressure hole, and wherein the back pressure valve is inserted into the first scroll-side back pressure hole.

6. The scroll compressor of claim 5, wherein a step portion is formed between the first scroll-side back pressure hole and the second scroll-side back pressure hole to limit movement of the back pressure valve, and wherein the step portion is formed to be tilted in a direction toward the second scroll-side back pressure hole.

7. The scroll compressor of claim 5, wherein a shortest length of a circumference connecting two adjacent refrigerant movement holes among the plurality of refrigerant movement holes is smaller than an inner diameter of the second scroll-side back pressure hole.

8. The scroll compressor of claim 5, wherein the back pressure valve further comprises expansion grooves formed in respective end portions of the plurality of refrigerant movement holes.

9. The scroll compressor of claim 8, wherein a shortest length of a circumference connecting two adjacent expansion grooves among the expansion grooves is smaller than the inner diameter of the second scroll-side back pressure hole.

10. The scroll compressor of claim 2, wherein the back pressure chamber assembly comprises a connection back pressure groove through which the plate-side back pressure hole and the scroll-side back pressure hole communicate with each other, and wherein an inner diameter of the connection back pressure groove is formed to be larger than an inner diameter of the scroll-side back pressure hole.

11. The scroll compressor of claim 10, wherein the connection back pressure groove is formed on a same axis with respect to the scroll-side back pressure hole and is formed eccentrically from the plate-side back pressure hole.

12. The scroll compressor of claim 10, wherein a valve limiting portion is formed on the connection back pressure groove to extend axially toward the non-orbiting scroll and limits movement of the back pressure valve.

13. The scroll compressor of claim 12, wherein a height of the valve limiting portion is less than or equal to a depth of the connection back pressure groove.

14. The scroll compressor of claim 2, wherein a portion of the scroll-side back pressure hole is covered with one surface of the back pressure chamber assembly, and wherein the back pressure valve axially overlaps the one surface of the back pressure chamber assembly that covers the portion of the scroll-side back pressure hole.

15. The scroll compressor of claim 3, wherein the back pressure hole comprises a scroll-side back pressure hole that is formed in the non-orbiting scroll and communicates with the compression chamber, and a plate-side back pressure hole that is formed in the back pressure chamber assembly and allows the scroll-side back pressure hole and the back pressure chamber to communicate with each other, wherein the scroll-side back pressure hole and the plate-side back pressure hole are formed eccentrically from each other, and wherein the back pressure valve is disposed inside of the plate-side back pressure hole.

16. The scroll compressor of claim 15, wherein a plate-side valve limiting portion is formed to protrude from an inner circumferential surface in one end portion, opposite to the scroll-side back pressure hole, of both end portions of the plate-side back pressure hole, so as to limit movement of the back pressure valve, and an inner diameter of the plate-side valve limiting portion is formed to be smaller than an outer diameter of the back pressure valve.

* * * * *